US008789891B2

(12) United States Patent
Wentworth et al.

(10) Patent No.: US 8,789,891 B2
(45) Date of Patent: Jul. 29, 2014

(54) METHOD AND APPARATUS FOR CREATING A PLANAR CAVERN

(76) Inventors: Steven W. Wentworth, Fountain Hills, AZ (US); Samuel T. Ariaratnam, Scottsdale, AZ (US); Robert F. Crane, Oconomowoc, WI (US)

( * ) Notice: Subject to any disclaimer, the term of this patent is extended or adjusted under 35 U.S.C. 154(b) by 204 days.

(21) Appl. No.: 13/212,594

(22) Filed: Aug. 18, 2011

(65) Prior Publication Data

US 2012/0043801 A1 Feb. 23, 2012

Related U.S. Application Data

(63) Continuation-in-part of application No. 12/904,707, filed on Oct. 14, 2010, now Pat. No. 8,646,846.

(60) Provisional application No. 61/452,980, filed on Mar. 15, 2011, provisional application No. 61/401,990, filed on Aug. 23, 2010.

(51) Int. Cl.
*E21B 43/28* (2006.01)

(52) U.S. Cl.
USPC ..... 299/5; 299/10; 299/35; 175/24

(58) Field of Classification Search
USPC ..... 166/302; 299/1.1, 3–6, 10, 15, 35; 405/129.2; 175/24, 53, 61, 62
See application file for complete search history.

(56) References Cited

U.S. PATENT DOCUMENTS 733,073 A 7/1903 Neukirch
753,092 A 2/1904 Neukirch
1,998,877 A 2/1934 Lawson
2,049,171 A 7/1935 Osgood
2,351,175 A 7/1939 Wilhelm (Continued)

FOREIGN PATENT DOCUMENTS

WO WO 2010074980 A1 7/2010

OTHER PUBLICATIONS

Xia et al., "Research on One Borehole Hydraulic Coal Mining System", China University of Geosciences (Beijing) and Peking University, Elsevier B.C., Earth Science Frontiers, vol. 15, Issue 4, Jul. 2008, 4 pages.

(Continued)

*Primary Examiner* — Yong-Suk (Philip) Ro
(74) *Attorney, Agent, or Firm* — Sheridan Ross P.C.

(57) ABSTRACT

Methods and apparatuses for producing a planar cavern are provided. The planar cavern is formed by first creating a continuous bore that extends through a subsurface resource deposit. The drill head used to create the bore can be steered in response to information about the concentration of the resource in the strata through which the drill head is passing, in order to keep the bore within resource deposit. The continuous bore can be formed by connecting first and second bores at a point within the subsurface resource deposit. After the continuous bore has been formed, a sawing assembly is placed within the continuous bore. The sawing assembly is then moved, in a continuous or in a reciprocating fashion, within the continuous bore. As the sawing assembly is moved, it is maintained under tension, to create a planar cavern. By thus exposing a large area of the resource deposit, a relatively large amount of the resource deposit can be dissolved in a solvent introduced to the planar cavern per unit time. Saturated solution can then be pumped from the planar cavern, and the resource recovered from the saturated solution by evaporation.

15 Claims, 15 Drawing Sheets

(56) References Cited

U.S. PATENT DOCUMENTS

| | | | | |
|---|---|---|---|---|
| 2,796,129 | A | 6/1957 | Brandon | |
| 3,620,573 | A | 11/1971 | Oxford | |
| 3,881,775 | A | 5/1975 | McPherson et al. | |
| 4,220,203 | A | 9/1980 | Steeman | |
| 4,232,904 | A | 11/1980 | Hurd | |
| 4,290,650 | A | 9/1981 | Thompson | |
| 4,406,499 | A | 9/1983 | Yildirim | |
| 4,442,896 | A | 4/1984 | Reale et al. | |
| 4,832,411 | A | 5/1989 | Johnston et al. | |
| 5,033,795 | A | 7/1991 | Farrar et al. | |
| 5,186,266 | A | 2/1993 | Heller | |
| 5,213,169 | A | 5/1993 | Heller | |
| 5,216,999 | A | 6/1993 | Han | |
| 5,472,262 | A * | 12/1995 | Buyens et al. | 299/15 |
| 5,542,782 | A | 8/1996 | Carter, Jr. et al. | |
| 5,651,639 | A | 7/1997 | Wentworth et al. | |
| 5,685,380 | A | 11/1997 | Purcell et al. | |
| 5,879,110 | A | 3/1999 | Carter, Jr. | |
| 5,890,840 | A | 4/1999 | Carter, Jr. | |
| 5,899,272 | A | 5/1999 | Loree | |
| 5,905,184 | A | 5/1999 | Carter, Jr. | |
| 5,957,624 | A | 9/1999 | Carter, Jr. et al. | |
| 6,148,935 | A | 11/2000 | Wentworth et al. | |
| 6,260,634 | B1 | 7/2001 | Wentworth et al. | |
| 6,261,027 | B1 | 7/2001 | Wentworth et al. | |
| 6,263,983 | B1 | 7/2001 | Wentworth et al. | |
| 6,269,889 | B1 | 8/2001 | Wentworth | |
| 6,280,000 | B1 | 8/2001 | Zupanick | |
| 6,280,521 | B1 | 8/2001 | Carter, Jr. | |
| 6,390,087 | B1 | 5/2002 | Wentworth et al. | |
| 6,419,013 | B1 | 7/2002 | Milne et al. | |
| 6,450,269 | B1 | 9/2002 | Wentworth et al. | |
| 6,569,235 | B2 | 5/2003 | Carter, Jr. | |
| 6,578,631 | B2 | 6/2003 | Milne et al. | |
| 6,755,593 | B2 | 6/2004 | Wentworth et al. | |
| 6,761,507 | B2 | 7/2004 | Wentworth et al. | |
| 6,860,936 | B2 | 3/2005 | Carter, Jr. | |
| 6,910,829 | B2 * | 6/2005 | Nickelson et al. | 405/129.2 |
| 7,066,283 | B2 | 6/2006 | Livingstone | |
| 7,086,808 | B2 | 8/2006 | Wentworth et al. | |
| 7,264,048 | B2 | 9/2007 | Zupanick et al. | |
| 7,290,625 | B2 | 11/2007 | Amaudric Du Chaffaut et al. | |
| 7,290,626 | B2 | 11/2007 | Terlet et al. | |
| 7,343,983 | B2 | 3/2008 | Livingstone | |
| 7,647,967 | B2 | 1/2010 | Coleman, II et al. | |
| 7,686,400 | B2 * | 3/2010 | Fredrick et al. | 299/1.1 |
| 8,387,688 | B2 | 3/2013 | Carter, Jr. | |
| 2003/0044238 | A1 | 3/2003 | Wentworth et al. | |
| 2003/0084764 | A1 | 5/2003 | Wentworth | |
| 2003/0173085 | A1 * | 9/2003 | Vinegar et al. | 166/302 |
| 2006/0039842 | A1 | 2/2006 | Day et al. | |
| 2010/0078218 | A1 | 4/2010 | Coleman, II et al. | |
| 2010/0108390 | A1 * | 5/2010 | Teodorescu | 175/57 |
| 2012/0043800 | A1 | 2/2012 | Wentworth et al. | |

OTHER PUBLICATIONS

International Search Report and Written Opinion for International Patent Application No. PCT/ US11/47280, mailed Jan. 26, 2012, 9 pages.

International Preliminary Report on Patentability for International (PCT) Patent Application No. PCT/US11/47280, mailed Mar. 7, 2013, 7 pages.

"Foremost Reverse Circulation Drill Pipe," Foremost Industries, 2009, [retrieved on Nov. 17, 2010], 5 pages. Retrieved from: www.foremost.ca/index_rcpipe.php.

"Series 1000—Widecutter for Marble," Dazzini Macchine Srl, 2010 [retrieved on Oct. 6, 2010], 1 page.

"Solution Mining—Overview," Western Potash, no date, [retrieved on Sep. 27, 2010], 3 pages. Retrieved from: www.westernpostash.com/about-potash/solution-mining.

Xia et al., "Research on One Borehole Hydraulic Coal Mining System," Earth Science Frontiers, vol. 15, Issue 4, Jul. 2008, 4 pages.

Wentworth et al., U.S. Appl. No. 12/904,707, Entitled "Method and Apparatus for Creating a Planar Cavern", filed Oct. 14, 2010, 33 pages.

Official Action for U.S. Appl. No. 12/904,707 mailed Jun. 28, 2013, 14 pages.

Notice of Allowance for U.S. Appl. No. 12/904,707 mailed Sep. 30, 2013, 6 pages.

Official Action for Canada Patent Application No. 2,808,408, mailed Mar. 4, 2014, 2 pages.

* cited by examiner

| RETURN SAMPLE CHEMISTRY ANALYSIS | | |
|---|---|---|
| SAMPLE CHEMISTRY STEERING | | |
| POINT | RESULT | CHANGE |
| 1 | 100 | HORIZ |
| 2 | 100 | HORIZ |
| 3 | 100 | HORIZ |
| 4 | 60 | DOWN |
| 5 | 100 | HORIZ |
| 6 | 100 | HORIZ |
| 7 | 60 | DOWN |
| 8 | 15 | UP |
| 7 (#2) | 60 | UP |
| 8 (#2) | 100 | HORIZ |

METHOD AND APPARATUS FOR CREATING A PLANAR CAVERN

CROSS-REFERENCE TO RELATED APPLICATIONS

This application claims the benefit of U.S. Provisional Patent Application Ser. No. 61/452,980, filed Mar. 15, 2011, and is a continuation-in-part of U.S. patent application Ser. No. 12/904,707, filed Oct. 14, 2010, which claims the benefit of U.S. Provisional Patent Application Ser. No. 61/401,990, filed Aug. 23, 2010, the entire disclosures of which are hereby incorporated herein by reference.

FIELD

The present invention is directed to producing a planar cavern. More particularly, the disclosed invention provides methods and apparatuses for precisely forming a planar cavern using directional drilling and rope sawing.

BACKGROUND

Various resource deposits can be mined from the Earth using man and machine entry techniques. With respect to resource deposits that are soluble, solution mining techniques can be used to remove the resource to the surface. In particular, solution mining involves dissolving a target evaporite in a solvent in situ to form a pregnant brine, and removing the pregnant brine to the surface. Evaporation, for example solar evaporation or evaporation aided by the addition of heat from a fossil fuel source, is then used to separate the target resource from the solvent.

Accordingly, solution mining requires transforming the target resource, such as halite (rock salt) or sylvite (potash), from a solid crystalline form to a brine. In particular, these salts are target minerals that will dissolve when wetted by the solvent to form the brine. The brine, replacing the volume of the target mineral in the crystalline state, is pumped from its below ground location to the surface and eventually to evaporation ponds or facilities. The rate of change from crystalline form to a dissolved form is a function of solvent temperature, purity (lack of solutes), agitation, and fluid pressure. As the goal is to produce a saturated brine (also known as a pregnant brine), purity cannot be positively affected, except that a solvent that is uncontaminated by other solutes can be applied. Agitation and control of solute temperature are variables that may be controlled to enhance productivity. Productivity of a bore may be defined as the total rate of change, measured in tons per day, of transformation of the target mineral from a crystalline state to a brine within the affected area of the bore.

In one approach, the resource deposit is accessed using a vertical access shaft. Because many resource deposits that are the target of solution mining are in the form of horizontally planar deposits, a vertical well typically provides a very limited area over which the bore perpendicular to the plane of the deposit in contact with the mineral resource. This limited surface area means that the area of the resource deposit exposed to the solvent is severely limited. This in turn limits the amount of the resource that can be placed in solution per unit time.

In order to increase the surface area of the resource deposit that can be contacted with solvent, horizontal bores can be formed using directional drilling techniques. In particular, bores can be formed that run through the resource deposit according to such techniques. Moreover, multiple horizontal bores in various patterns, such as an X, a fan, or rectangular grid, can be used. However, because the initial area of exposed resource deposit is limited to the area of the one or more bores within the resource deposit, the amount of the resource that can be placed in solution per unit time remains limited.

Further, such mineral formations may be vertically thin and of great horizontal size. The process of deposition is the evaporation of ancient inland seas that occurred when a saltwater inlet became cut off geographically from the main sea. The shallow areas experienced oversaturation of the brine as the water level dropped due to evaporation resulting in deposition of salts as various salinity and atmospheric conditions were reached. As the most valuable mineral tends to be a small fraction of the dissolved solids found in sea water, the thickness of the deposited layer is typically thin. Therefore a way to capitalize on relatively common vertically thin and horizontally broad deposits will make otherwise valueless deposits of economic interest.

At least partially as a result of these limitations, major mining operations of resource deposits, such as potash, typically utilize man and machine entry techniques and occur only in areas with exceptionally large deposits. Large not only in breadth, but also in depth. For this rare situation to occur, the amount of evaporation need have been extreme with conditions remaining stable for decades or longer. Such a deposit did occur in central Canada around the present day location of the city of Saskatoon. The deposit is deep (3000 plus feet below the surface) but incredibly rich. The richness of the deposit is indicated by the fact that this region currently produces about ⅓ of the global potash usage. However, because this deposit is in a climactic area that is not amenable to the use of solar evaporation to recover the resource from the pregnant brine, heating, for example by burning natural gas, is required. Therefore, large amounts of energy must be expended in connection with such mining operations. Conversely, areas with large amounts of resource deposits that are in relatively thin, planar formations, do occur in locales in which solar evaporation could be used efficiently. However, conventional mining of such deposits has typically been uneconomical. Vertically deep deposits lend themselves well to man entry techniques, vertically thin deposits require novel and inventive means to claim them from the Earth.

SUMMARY

Embodiments of the present invention are directed to solving these and other problems and disadvantages of the prior art. In accordance with embodiments of the present invention, methods and systems for creating precision planar caverns are provided. In particular, a bore is formed from a first access point on the surface that extends down to a resource deposit.

Once the resource deposit is reached, the bore continues horizontally through the resource deposit. As used herein, horizontal means within a plane traversing and/or substantially parallel to a mineral deposit. While gravity deposited the crystalline mineral in a perfectly flat plan, geological forces may have tilted the plane from the horizontal slightly over eons, requiring the boring operator to perform guidance with full knowledge that the bore path will remain within the highest grade of the target material. Failure to remain in the high grade plane of the target mineral could produce a brine with a low value mixture of salts and therefore result in economic failure of the mining operation. Novel and distinct steering guidance is revealed within the body of this application.

Upon completing a loop within the plane of the target mineral, the bore is continued back to the surface at a second access point. Accordingly, a continuous bore is formed between the first and second access points. In accordance with embodiments of the present invention, the bore extends through the resource deposit for some distance, before looping back to the second access point to define a perimeter. A sawing assembly is then placed in the continuous bore preferably along with solvent, and is moved relative to the bore, to cut, erode or shear the resource and to thereby create a planar cavern. If there is solvent present during the sawing operation, the chips or spoil produced during sawing will rapidly transform from solid to brine, reducing or eliminating re-cutting of chips, and challenges of chip removal or heat buildup within the saw itself.

In accordance with at least some embodiments of the present invention, a first blind bore, extending from a first access point, is formed. The first bore includes a first angled or tilted portion that extends from the first access point, through the overburden and to the resource deposit. The first bore is then guided to follow the resource deposit for a first distance, forming a first leg. The first leg is terminated in a curve. The curve initiates a second leg, also guided to remain in the resource deposit. The second leg can be terminated in a dog leg curve. A second bore is formed starting at a second access point. The second bore includes a second angled or tilted portion that extends through the overburden to the resource deposit. The second bore then follows the resource deposit for a second distance, forming a first leg of the second bore. The second bore is then directed to intersect the dog leg portion of the first bore, to form a continuous bore. In accordance with embodiments of the present invention, the first leg of the second bore may be formed so that it is parallel or substantially parallel to the first leg of the first bore. Moreover, the first leg of the second bore can terminate in a curve that forms the beginning of a second leg of the second bore. The second leg of the second bore may be parallel or substantially parallel to the second leg of the first bore. By extending the second leg of the second bore until it intersects the dog leg portion of the first bore, the continuous bore is formed.

Horizontal steering guidance can be supplied by one of several successful horizontal directional drilling systems or devices, such as the PARATRACK system sold by PRIME HORIZONTAL of Holland, or the VECTOR MAGNETICS system supported by IN ROCK. Either system will provide an accurate indication of where the steering head is located and its inclination with respect to gravity, however no existing system will provide feedback on the material the boring head is operating in. As it is desirable to keep the path of the bore and therefore the edges of the plane created by sawing in the richest zone of the target mineral, it is beneficial that the operator be provided with rapid feedback on the chemistry of the material being drilled. Once in the mineral formation, it is most valuable to have the drill head stay in the richest vein rather than follow a predetermined elevation or path. With knowledge of chemistry from the environs local to the drill head, as well as the information for the previous sample, the operator has the means to compare properties of the material recently drilled. This allows understanding of whether the trend is into or away from the richest vein.

Typically utility installation requires that directionally drilled bores hold a particular depth of cover below the surface, or a desired pitch if flowing fluids using gravity; therefore the drill path guidance instrumentation used typically references either the Earths gravitational field or magnetic field. Mineral and natural resource recovery wells however are guided to facilitate reclamation of said resource. While survey information will exist and be available to the drill operators, that data tends to be sparse and widely spaced, leaving the task of keeping the bore path in the appropriate location relative to the deposit up to the drill rig manager.

Decisions regarding vertical adjustment in bore path while in an evaporite field are best made based on mineral properties. Determining these mineral properties to quantify the level of richness at the drill head fall into one of three categories:

a) Previous exploration has mapped the deposit quality as a function of depth.
b) Deposit sampling is performed continuously or at regular intervals and returned to the surface for evaluation.
c) Local deposit properties are measured insitu at or just behind the drill head, with results being transmitted to the surface using MWD or Measurement While Drilling equipment.

The weakness of category A as summarized above is the typical sparseness of the available data and the great cost to enhance the spatial frequency of the samples. This data is used as a guide to determine whether or not to attempt recovery and the approximate depth(s) that recovery might occur rather than defining the fine vertical adjustments of the bore path within the formation.

Category B has many advantages; measurement equipment need not be configured for MWD, and there is no fragile data transmission path involved between the drill head and the surface. However, it is often desirable to use incrementally higher cost dual path/dual wall drill stem to facilitate sample return and a time lag between when the sample enters the return passage of the dual path stem and when it emerges at the surface.

Category C requires MWD equipment be deployed along with the frustration of hardwire or other communication means from drill head to surface. However the method returns near instantaneous values and has relatively little risk of sample contamination. Qualities that the evaporite exhibits may be change in electrical conductivity in the dissolute state or more likely, measurement of radiation levels. Natural Potassium contains an isotope that emits both beta and gamma radiation. It is such a dependable source that KCL may be used as a calibration source for radiation monitoring devices. The oil industry uses gamma ray detection devices deployed as MWD's on a very common basis and the technology is readily commercially available.

While novel sampling methods that fall into category B are described herein, it is not required to use a novel method to achieve the most lucrative bore path. Rather it is important that guidance of the bore path, primarily in the vertical direction, be evaluated on a frequent basis so that the plane of the cavern be in, or just below the richest zone of the target mineral. Depending on the depth of the deposit, the driller may be best served with gamma ray detection, or in shallow deposits, it may be most cost effective to seek return samples from a dual wall pipe, or even from a 'chase' pipe inserted into the bore alongside the main drill pipe whose only purpose is to extract samples.

Fortunately the best choice of drilling fluid delivered to the drill head is the solvent that will be used to dissolve the mineral. Traditional drilling fluids would contaminate the brine and provide a barrier on the formation that would slow the dissolution process. By returning the cuttings up the same drill stem as the solvent is being simultaneously being delivered through, the operator is provided with a near instantaneous read on the material properties. This is possible by using a dual wall drill stem system such as that manufactured by FOREMOST and called reverse circulation drill pipe.

While use of dual wall drill stem is not mainstream, the benefit derived from the added cost borne yields the ability to make steering corrections that keep the periphery of the planar cavern in the richest zone.

Once the first, second and/or continuous bores are formed, the drill string(s) used to form the bores can be withdrawn. A drill string can then be reinserted, or inserted further through either the first access point or the second access point, to tow the sawing assembly through the continuous bore. In accordance with embodiments of the present invention, the sawing assembly includes a plurality of cutting bits disposed at intervals along a sawing assembly rope. A first end of the sawing assembly, extending from the first access point, can be interconnected to a first portion of an actuator or a winch assembly. A second end of the sawing assembly can be interconnected to a second portion of the winch assembly. The sawing assembly can then be moved relative to the continuous bore, such that the cutting bits act against a surface of the resource deposit exposed by the continuous bore. By applying and maintaining tension in the sawing assembly, the cutting bits may be drawn through the resource deposit, creating a planar cavern. After the sawing assembly has been drawn through the resource deposit, or the edge of the planar cavern has been advanced along all or nearly all the lengths of the first legs of the first and second bores, the sawing operation can be discontinued. During the sawing operation, a solvent can be introduced into the cavern, to dissolve the exposed resource. Because the planar cavern exposes a large area of the resource deposit, a relatively large amount of the resource can be dissolved per unit time.

An apparatus in accordance with embodiments of the present invention includes a sawing assembly. The sawing assembly includes a sawing assembly tensile member or rope, and cutting bits attached at intervals to the sawing assembly tensile member or rope. Moreover, the cutting bits can be bidirectional, and can be disposed between first and second ends of the sawing assembly rope. A first end of the sawing assembly rope can be interconnected to a first portion of a winch assembly, while the second end of the sawing assembly rope can be interconnected to a second portion of the winch assembly. In accordance with further embodiments, a winch assembly can comprise first and second winches, that are interconnected to a common control system.

Additional features and advantages of embodiments of the disclosed invention will become more readily apparent from the following description, particularly when taken together with the accompanying drawings.

DETAILED DESCRIPTION

Figure 1:
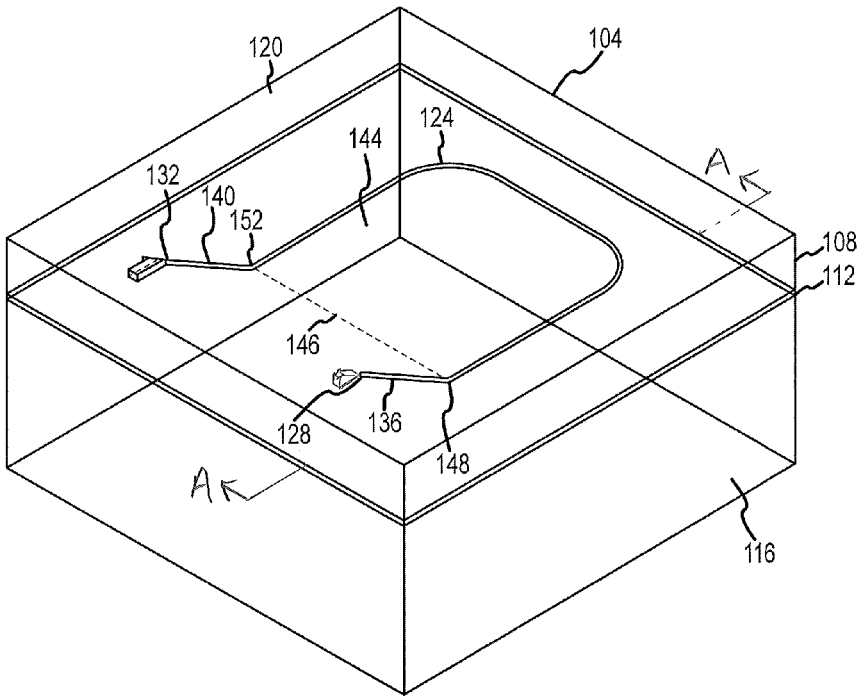
FIG. 1 is a perspective view of a mineral deposit accessed by a bore formed in accordance with embodiments of the present invention.

FIG. 1 is a perspective view of a section of earth 104 that includes an overburden section 108, a resource deposit 112 generally underlying the overburden 108, and a substrate portion 116, generally underlying the resource deposit 112. As depicted in the figure, the resource deposit 112 comprises a planar deposit. Although depicted in the figure as being constrained within a plane that is parallel to the surface 120 of the section 108, it should be appreciated that the resource deposit 112 can be within a plane that is tilted with respect to the surface 120, and/or that is tilted with respect to an absolute horizontal reference. In accordance with embodiments of the present invention, the resource deposit 112 may comprise a mineral deposit. Moreover, the resource deposit 112 may comprise minerals that can be dissolved by a solvent, and removed to the surface as a saturated solution or brine. Accordingly, examples of a mineral deposit 112 that can be effectively mined using embodiments of the present invention include but are not limited to potash and rock salt.

In accordance with embodiments of the present invention, the resource deposit 112 is accessed by a continuous bore or borehole 124 that extends between a first access point or hole 128 and a second access point or hole 132. In general, the continuous bore 124 includes a first tilted shaft portion 136 that extends from the first access point 128 on the surface 120, through the overburden 108 and to the resource deposit 112. The continuous bore 124 then extends some distance from the first tilted shaft 136 through the resource deposit 112, and turns or loops back to a second tilted shaft 140 that extends from the resource deposit 112 to the second access point 132 on the surface 120. Accordingly, the continuous bore 124 generally defines an area 144 within the resource deposit 112, between the down hole end 148 of the first tilted shaft 136 and the down hole end of 152 of the second tilted shaft 140, and a line (shown as a dashed line 146) between the down hole ends 148 and 152 of the tilted shafts 136 and 140. As will be described herein, embodiments of the present invention allow a planar cavern to be formed that extends through at least most of this area 144. Moreover, because both the floor and ceiling of this cavern can comprise the resource deposit 112, the surface area of the resource deposit 112 that is made available by the cavern to be contacted by a solvent is very large.

Figure 2:
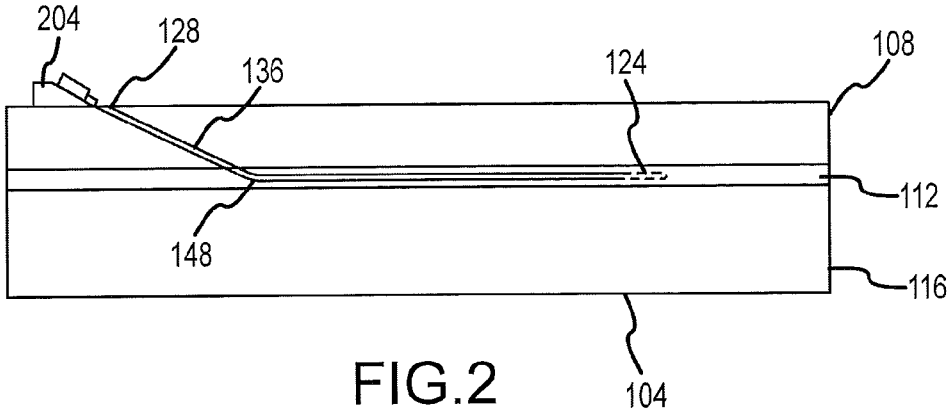
FIG. 2 is a cross-section in elevation of a mineral deposit accessed by a bore formed in accordance with embodiments of the present invention.

FIG. 2 is taken along section line A-A of FIG. 1, and illustrates the continuous bore 124 in cross-section. In addition, a horizontal directional drilling rig 204 is depicted. As used herein, a horizontal directional drilling rig 204 includes a rig or assembly with a drill head that is capable of being steered such that a bore can be formed in a desired location, direction and depth. In general, the horizontal directional drilling rig 204 is used to form the continuous bore 124, starting with the first tilted shaft 136 at the first access point 128. The first tilted shaft 136 extends downwardly, through the overburden 108, until the resource deposit 112 is reached. At the down hole end 148 of the first tilted shaft 136, the horizontal directional drilling rig 204 is turned within a vertical plane, so that the continuous bore 124 extends through the resource deposit 112. In particular, the continuous bore 124 extends horizontally through the resource deposit. As used herein, horizontally means within a plane traversing or substantially parallel to a plane along which a target resource or resource deposit 112 is deposited. In particular, embodiments of the present invention include continuous bores 124 that, at least between the down hole ends 148 and 152 of the tilted shafts 136 and 140, are within or substantially within resource deposit 112, whether or not the resource deposit 112 lies in a plane that is tilted with respect to an absolute horizontal reference.

Figure 3:
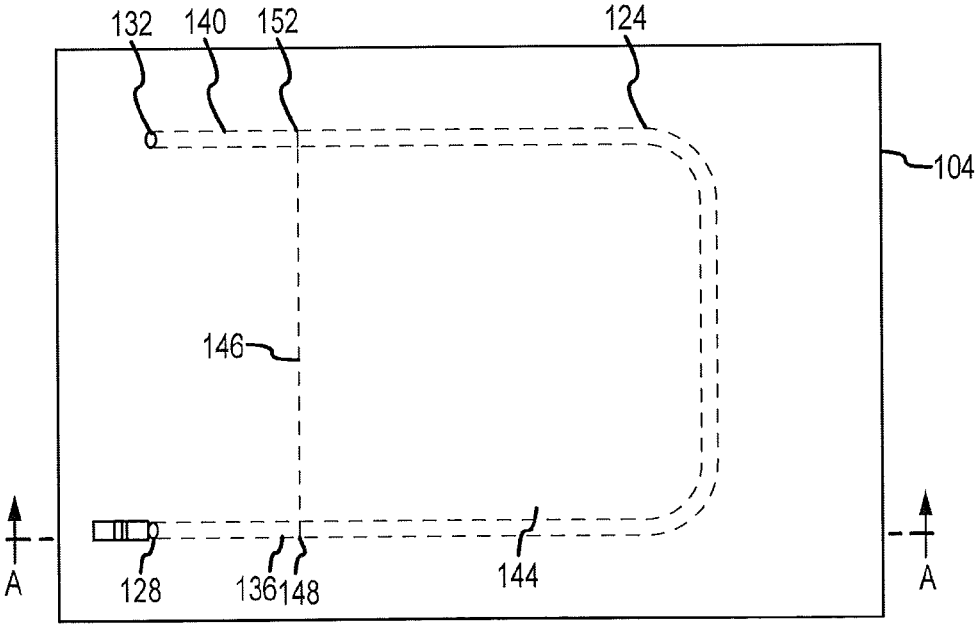
FIG. 3 is a plan view of a mineral deposit accessed by a bore formed in accordance with embodiments of the present invention.

FIG. 3 is a plan view of the continuous bore 124 illustrated in FIGS. 1 and 2. As seen in FIG. 3, the continuous bore 124 can define three sides of a rectangular area 144, with a fourth side of the rectangular area 144 corresponding to a line 146 between the down hole end 148 of the first tilted shaft 136 and the down hole end 152 of the second tilted shaft 140. As will be described herein, the majority of the resource deposit 112 within the area 144 can be accessed by embodiments of the present invention by forming a planar cavern therein.

Figure 4:
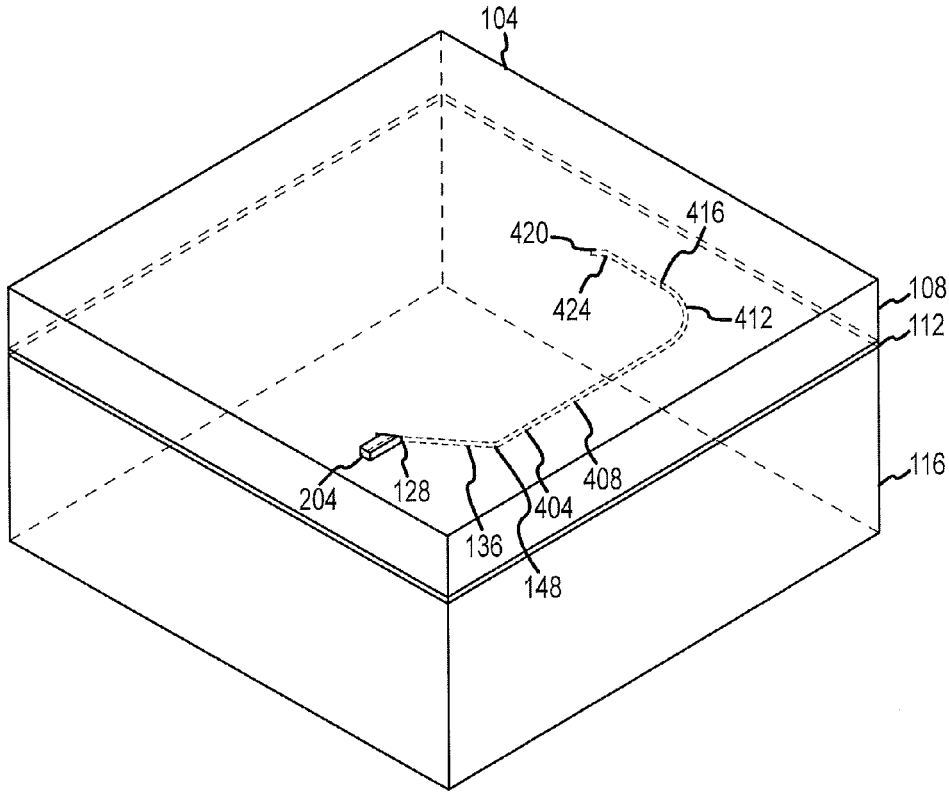
FIG. 4 is a perspective view of a first bore formed in accordance with embodiments of the present invention.

As can be appreciated by one of skill in the art after consideration of the present disclosure, forming a continuous bore 124 in a single directional drilling operation can, using commonly available drilling equipment, be impractical. Accordingly, formation of the continuous bore 124 may be accomplished by forming first and second bores using horizontal directional drilling techniques. In particular, as illustrated in FIG. 4, a blind first bore 404 can be formed. In general, the first bore 404 is formed using a horizontal directional drilling rig 204, and extends from the first access hole 128, down the first tilted shaft 136, and turns in elevation to form a first leg 408, which follows the resource deposit 112. An end of the first leg 408 can be defined at a first curve or arc 412, and continues for some distance along a second leg 416 to a blind terminus or end point 420. This second leg 416 can be within the resource deposit and at an angle of 90° with respect to the first leg 404. Moreover, in accordance with embodiments of the present invention, the first bore 404 is, from the down hole end 148 of the first tilted shaft 136 until the blind end 420, entirely within the resource deposit 112. In accordance with further embodiments of the present invention, the second leg 416 of the first bore 404 can include a slight curve or dog leg 424 prior to the blind end point 420. As can be appreciated by one of skill in the art after consideration of the present disclosure, the provision of a dog leg 424 at or towards the end point 420 of the first bore 404 can increase the area of the target presented by the first bore 404 to a second bore.

Figure 5:
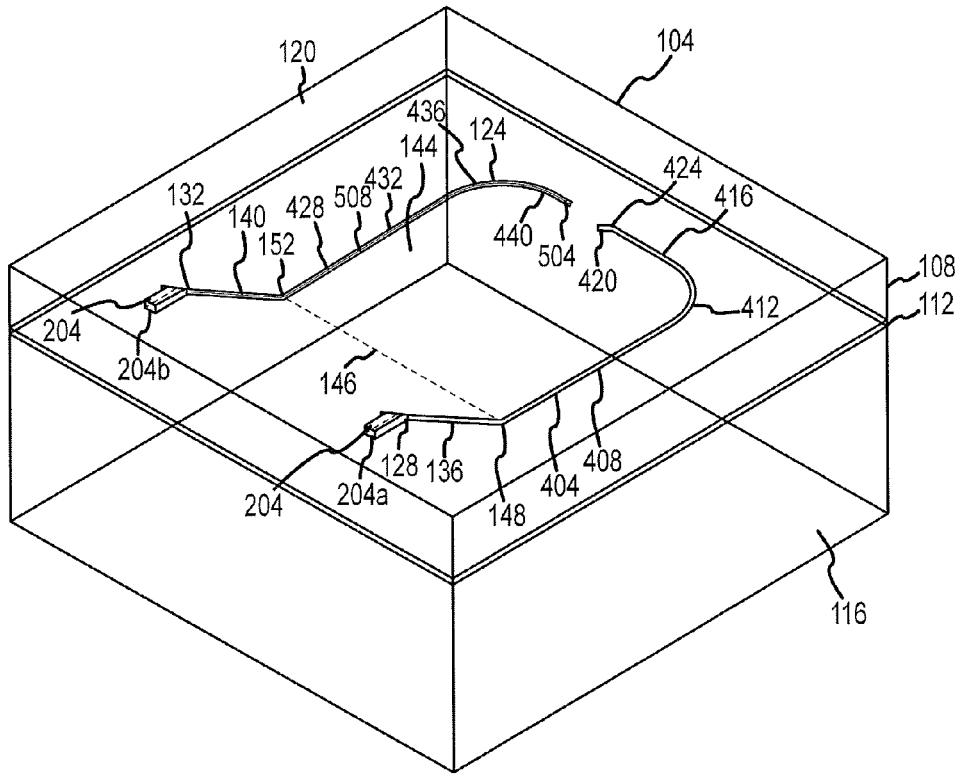
FIG. 5 is a perspective view of a first bore and a partially completed second bore in accordance with embodiments of the present invention.

With reference to FIG. 5, a second bore 428 is illustrated in a partially completed state. In particular, the second bore 428 extends from the second access hole 132, down a second tilted shaft 140, and from the down hole end 152 of the second tilted shaft 140 to a first leg 432 of the second bore 428, through a curve 436 that turns the second bore 428 towards the end point 420 of the first bore 404, and that forms the beginning of a second leg 440 of the second bore 428. In the state illustrated in FIG. 5, the second bore 428 is in the process of being formed using a horizontal directional drilling rig 204 located at or adjacent the second access hole 132. In particular, the horizontal directional drilling rig 204 at the second access hole 132 is operated to direct a drill head or bit 504 at the end of a drill string 508 such that the second bore 428 is steered towards and intersects the terminal end 420 or dog leg portion 424 of the first bore 404. In accordance with embodiments of the present invention, intersecting the first bore 404 with the second bore 428 is facilitated by the provision of the dog leg portion 424 at or near the terminal end 420 of the first bore 404. By thus interconnecting the first bore 404 with the second bore 428, a continuous bore 124 (see FIG. 1) is formed. In accordance with embodiments of the present invention, the second bore 428 is, from the down hole end 152 of the second tilted shaft 140 to the point at which it intersects the first bore 404, entirely within the resource deposit 112.

After the first bore 404 has been completed up to the terminal end 420, the drill head used to form the first bore 404 can be pulled back to the end of the second leg 416 of the first bore 404, such that the drill head and drill string do not occupy the first bore 404 from the dog leg portion 424 to the end point 420. However, the drill stem can be left in the remainder of the first bore 404. As can be appreciated by one of skill in the art after consideration of the present disclosure, withdrawing the drill head and drill stem from the end portion of the first bore 404 leaves that portion clear to prevent possible damage to the drill head and connected drill string when the second bore 428 is connected to the first bore 404. The drilling rig 204 can then be disconnected from the drill string at the first access hole 128, and moved to the second access hole 132 (or the area in which the second access hole 132 is to be formed) to drill the second bore 428. Alternatively, a first horizontal directional drilling rig **204*a* can be used to form the first bore 404 while a second horizontal directional drilling rig 204*b* can be used to form the second bore 428**.

Figure 6:
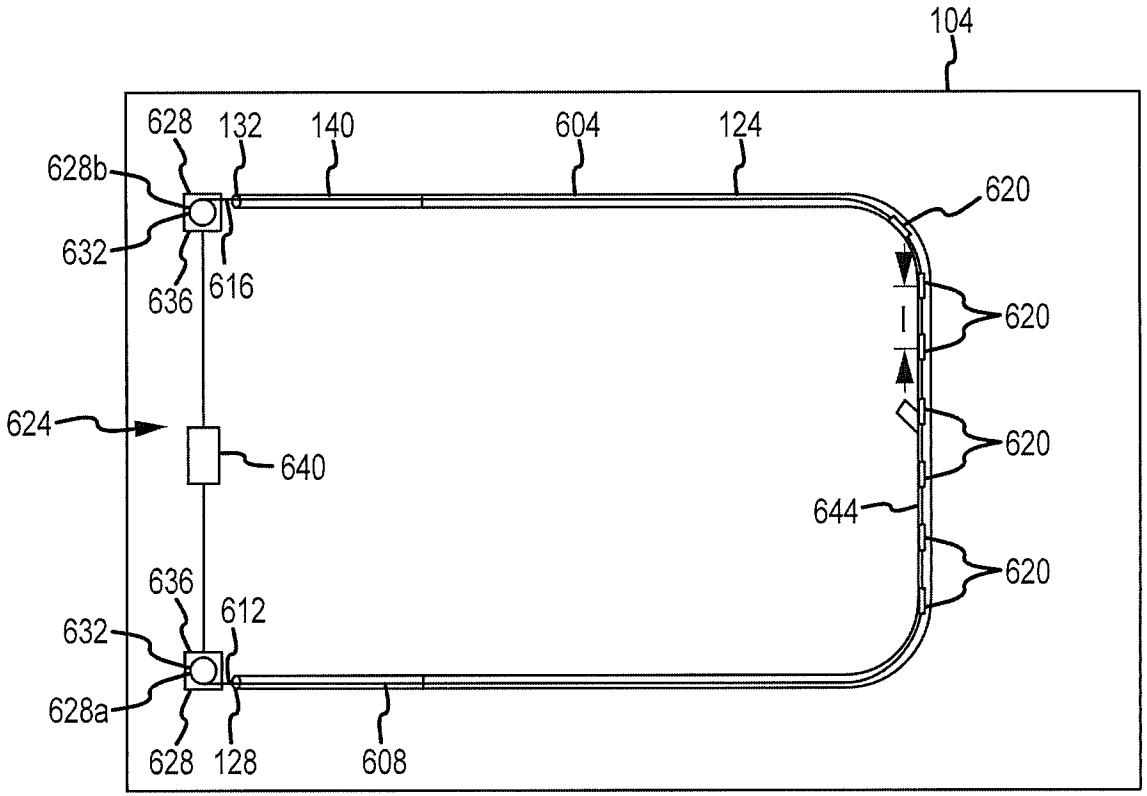
FIG. 6 is a plan view of a continuous bore with a sawing assembly inserted therein in accordance with embodiments of the present invention.

FIG. 6 is a plan view of a continuous bore 124, with a sawing assembly 604 in accordance with embodiments of the present invention inserted therein. In the figure, the overburden is shown as if it was transparent, to facilitate illustration of the sawing assembly 604 in the continuous bore. In general, the sawing assembly 604 includes a rope member 608 with a first end 612 that extends from the first access hole 128 and a second end 616 that extends from the second access hole 132. The sawing assembly 604 also includes a plurality of cutting bits 620 that are fixed to the rope member 608 at intervals I along the rope member 608. Insertion of the sawing assembly 604 in the continuous bore 124 can be accomplished by towing the assembly from the first access point 128 to the second access point 132, or alternatively from the second access point 132 to the first access point 128, using a drill string.

The first 612 and second 616 ends of the sawing assembly 604 are interconnected to an actuator or a winch assembly 624. In general, the winch assembly 624 can operate to cycle or reciprocate the sawing assembly 604 over a distance that is equal to or greater than the interval I separating the centers of adjacent cutting bits 620. The cutting bits 620, which act on a receding or eroded edge 644 of the resource deposit 112 through tension and motion applied to the sawing assembly 604 by the winch assembly 624, erode that receding edge 644 of the resource deposit 112. The winch assembly 624 can include a first winch unit 628*a* to which the first end 612 of the sawing assembly 604 is interconnected, and a second winch unit 628*b* to which the second end 616 of the sawing assembly rope 608 is interconnected. Each winch unit 628 generally includes a rope handling unit or drum 632 and a drive motor or engine 636. Alternatively, one engine 636 can be used, since only one end 612 or 616 of the sawing assembly 604 is pulled at a time. The winch assembly 624 can additionally include a controller 640, to coordinate operation of the winch units 628.

Figure 7:
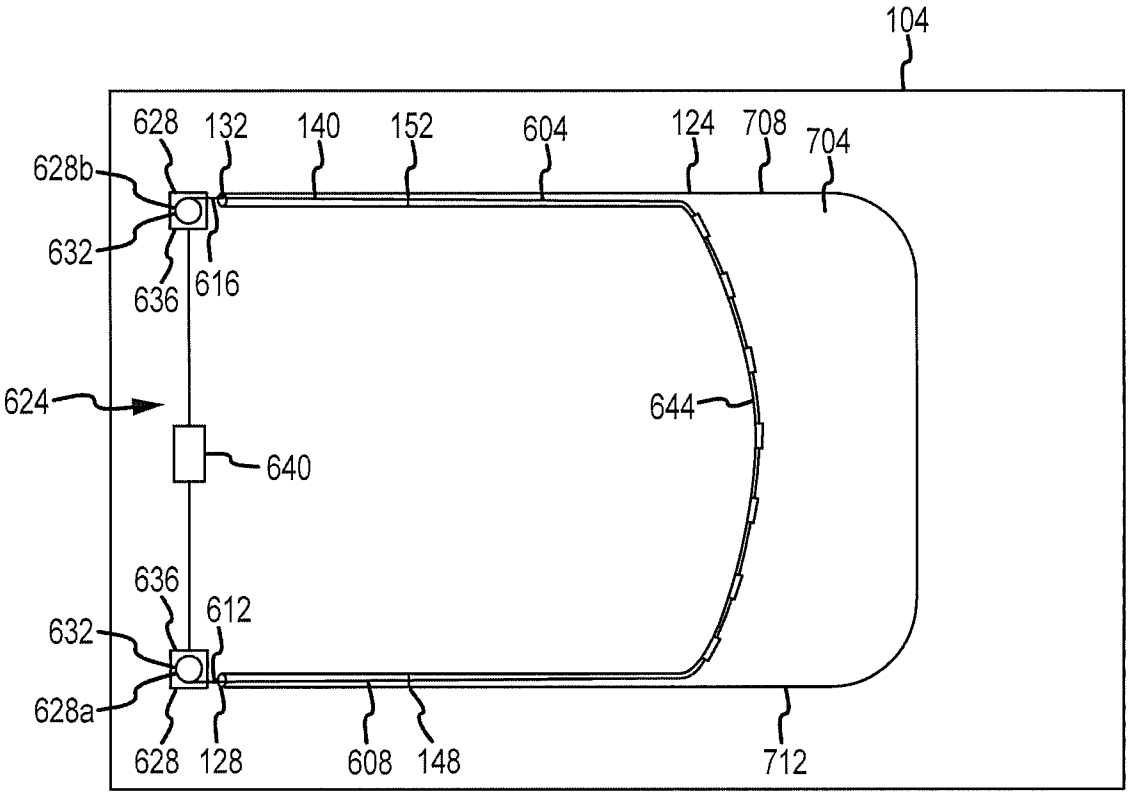
FIG. 7 is a plan view of a partially completed planar cavern in accordance with embodiments of the present invention.

FIG. 7 is a plan view of a partially completed planar cavern 704 created by the reciprocation or movement of the sawing assembly 604 in the continuous bore 124. The overburden is again shown as if it was transparent, to facilitate illustration of the sawing assembly 604 in the continuous bore 124, and the planar cavern 704 being formed. In particular, the eroded edge 644 has advanced towards the down hole ends 148 and 152 of the first and second tilted shafts 136 and 140, extending the area of the planar cavern 704. Moreover, first 708 and second 712 side surfaces of the planar cavern 704 can be seen to correspond to the first legs 408 and 432 of the first 404 and second 428 bores. In order to facilitate the removal of shavings produced by the cutting action of the sawing assembly 604, solvent can be added to the well or continuous bore 124. Because the shavings produced by the cutting action of the sawing assembly 604 are relatively high in surface area and low in cross section, they will dissolve relatively quickly in the solvent. Dissolution of the shavings can also be promoted by the agitation provided by the movement of the sawing assembly 604 in the continuous bore 124.

Figure 8:
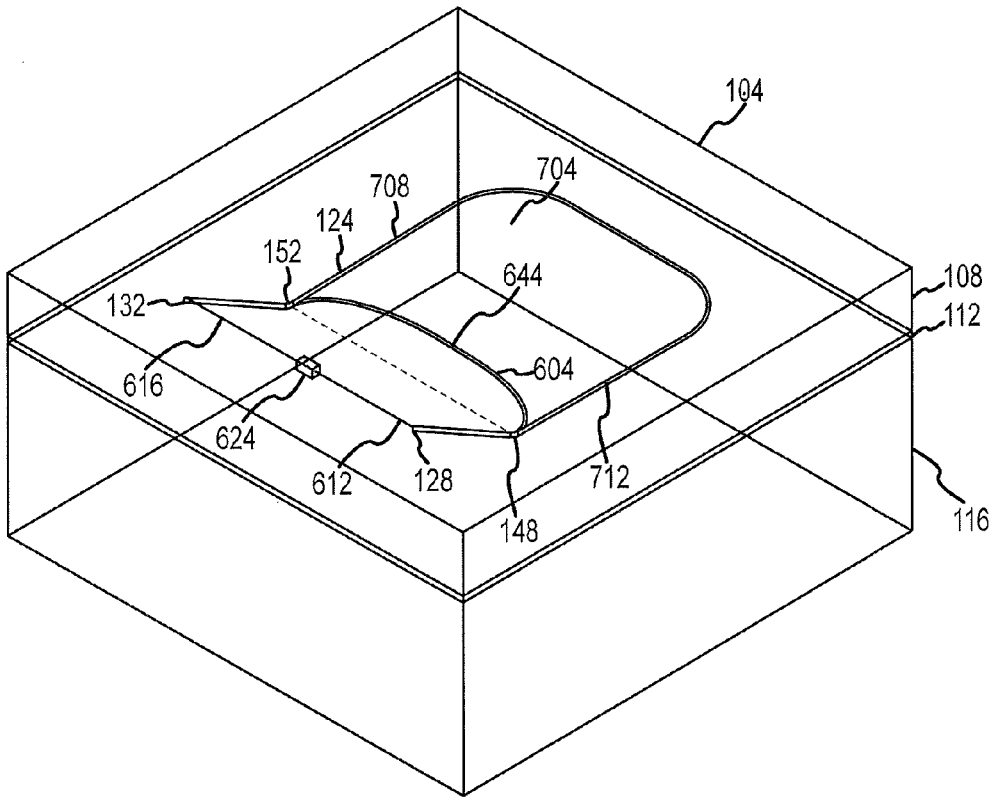
FIG. 8 is a perspective view of a planar cavern and a sawing assembly after a sawing operation in accordance with embodiments of the present invention is complete.

FIG. 8 is a perspective view of a planar cavern and the sawing assembly after a sawing operation to form a planar bore in accordance with embodiments of the present invention is complete. As shown in the figure, the down hole portions of the sawing assembly 604 have advanced, moving the eroded edge 644 of the planar cavern 704 towards the down hole ends 148 and 152 of the tilted shafts 136 and 140. FIG. 8 also shows that the eroded edge 644 of the planar cavern 704 has acquired a curved shape. For example, the eroded edge 644 may have a parabolic shape after sawing using the sawing assembly 604. In addition, once the eroded edge 644 of the planar cavern 704 has advanced along all or substantially all of the first leg portions 408 and 428 of the continuous bore 124, the sawing operation is halted. The sawing assembly 604 can then be withdrawn from the continuous bore 124 and the planar cavern 704. The planar cavern 704 remaining after completion of the sawing operation presents a very large surface area. Moreover, where the planar cavern 704 is formed such that all surfaces of the planar cavern are within the resource deposit 112, the area of resource deposit that can be exposed to a solvent is very large, especially as compared to the surface area of a resource deposit that is exposed using conventional vertical or horizontal drilling techniques.

Figure 9:
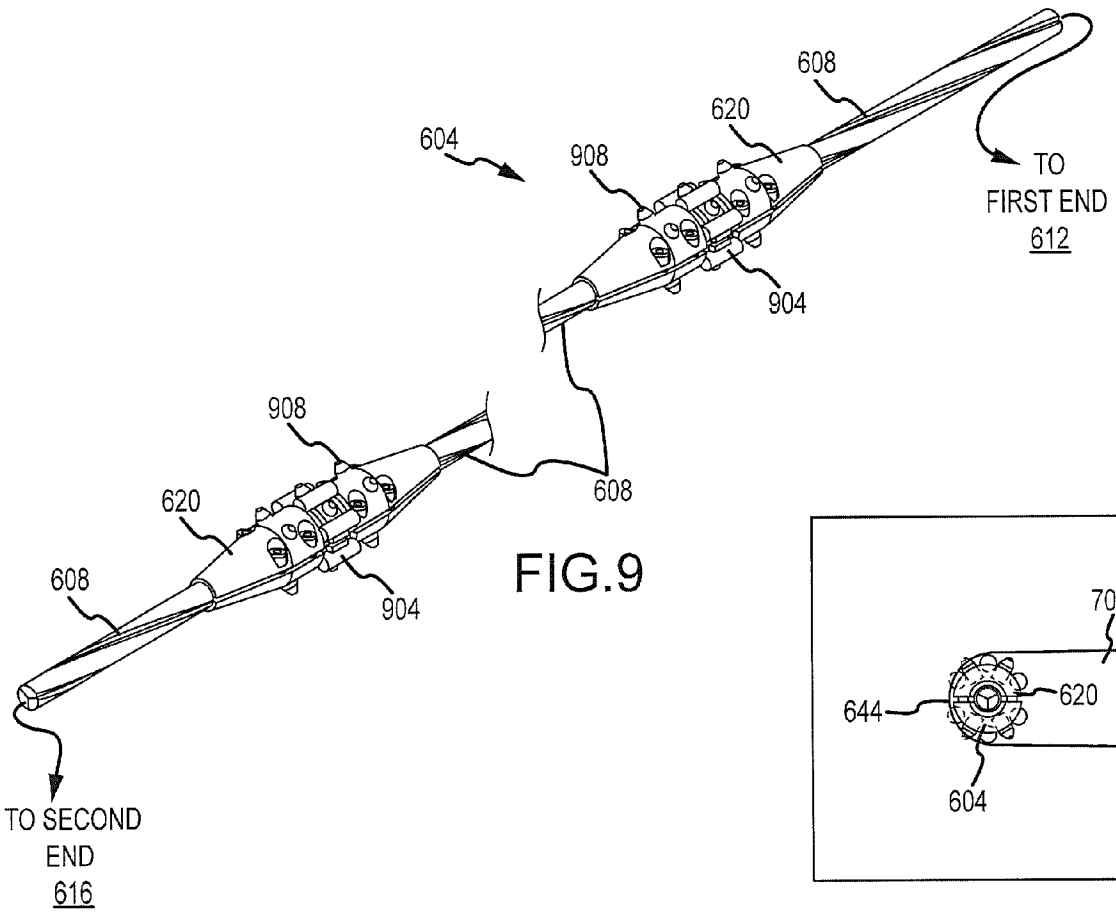
FIG. 9 is a perspective view of a portion of a sawing assembly in accordance with embodiments of the present invention.

FIG. 9 is a perspective view of a portion of a sawing assembly 604 in accordance with embodiments of the present invention. As illustrated in the figure, the sawing assembly includes a rope 608 and a plurality of cutting bits 620. The cutting bits 620 are fixed to the rope 608 at intervals. The cutting bits 620 can include a plurality of bidirectional cutters 904 and/or studs 908 that bear against the resource deposit and shear material therefrom as the cutting assembly 604 is towed across the eroded edge 644 of the resource deposit 112. In accordance with embodiments of the present invention, the rope 608 may comprise a 3×19 swaged style rope. In accordance with other embodiments, the rope 608 may comprise flexible rod. In accordance with still other embodiments, the rope 608 may comprise one or more components that are flexible enough to travel along the length of the continuous bore 124, and that are strong enough to transfer tensile force from the winch assembly 624 to the cutting bits 620.

Figure 10:
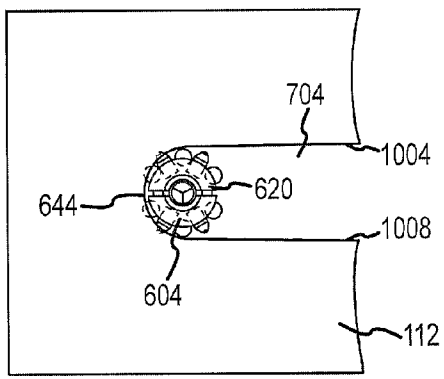
FIG. 10 is a cross-section of a sawing assembly used to form a planar cavern in accordance with embodiments of the present invention, in a section of a mineral deposit.

FIG. 10 is a cross-section of a sawing assembly 604 eroding a resource deposit 112 along the receding edge 644 of a planar cavern 704 in accordance with embodiments of the present invention. As illustrated in the figure, the planar cavern 704 thus formed includes a ceiling 1004 and a floor 1008.

Figure 11:
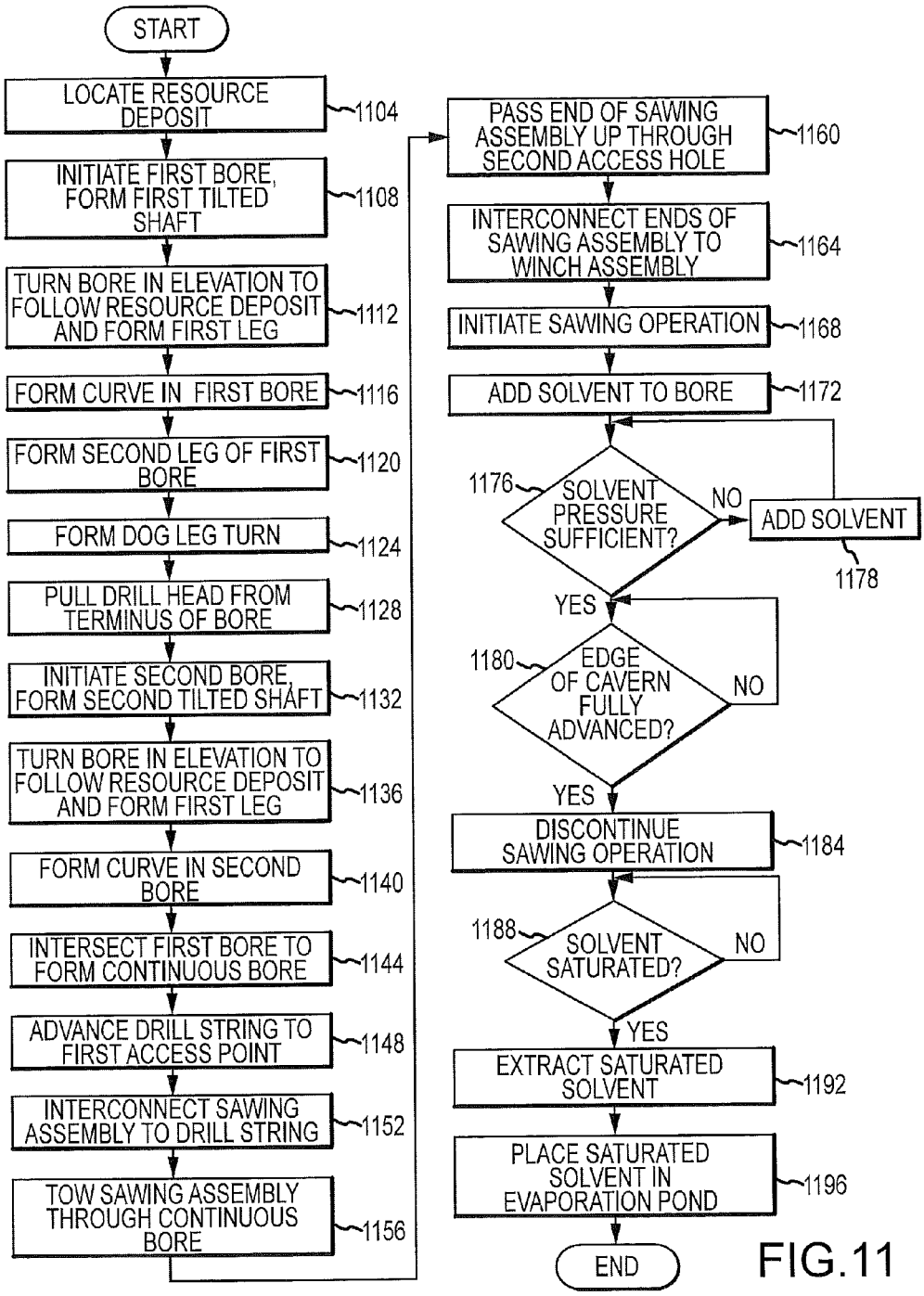
FIG. 11 is a flowchart depicting aspects of a process for forming a planar cavern in accordance with embodiments of the present invention.

FIG. 11 is a flowchart depicting aspects of a process for forming a planar cavern in accordance with embodiments of the present invention. Initially, at step 1104, a planar or stratified resource deposit 112 is located. The resource deposit 112 is then accessed by a first, non-planar bore 404, initiated from the first access point 128 (step 1108). The first bore 404 can be formed using horizontal directional drilling techniques. Moreover, the first bore 404 can extend from the first access point 128, through the overburden at, for example, a 30° angle forming a first tilted shaft 136 until the resource deposit 112 is reached. At step 1112, the horizontal directional drill is controlled so that a first leg 408 of the bore follows the plane of the resource deposit 112. For example, if the resource deposit 112 occupies a horizontal plane, the first bore 404 will level out and follow a horizontal path. As can be appreciated by one of skill in the art after consideration of the present disclosure, the first leg 408 of the first bore 404 need not follow a horizontal path, for example where the resource deposit 112 is tilted. In such instances, the first bore 404 will, in the first leg 408, follow a path that maintains the first bore 404 within the resource deposit 112. After extending along the first leg 408 for a desired distance, a bend or curve is formed (step 1116). For example, the curve can be contained until a 90° change of direction has been achieved and a second leg 416 of the first bore 404 has been formed. The second leg 416 extends for some distance, for example for about half the distance of the first leg (step 1120). At step 1124, the direction of the second leg 416 is changed, so that the first bore 404 presents additional area in a plane that is generally transverse to the direction of the second leg 416 of the first bore 404. For example, a dog leg turn can be formed immediately prior to the end point 420 of the first bore 404. At step 1128, the drill head is pulled back from at least the dog leg portion 424 of the first bore 404, while leaving the drill string in the remainder of the first bore 404 to prevent a bore cave in.

At step 1132, a second bore 428 is initiated from the second access point 132. The second bore 428 can be started parallel to and offset from the first leg 408 of the first bore 404. More particularly, the second bore 428 may comprise a near mirror image of the first bore 404. Accordingly, the second bore 428 may gain depth by traveling at an angle of 30° to the horizontal forming a second tilted shaft 140 until the resource deposit 112 is reached. A first leg 432 of the second bore 428 can then be formed by leveling out or otherwise turning in elevation to follow the plane of the resource deposit 112 along a line that is generally parallel to the first leg 408 of the first bore 404 (step 1136). The first leg 432 of the second bore 428 is continued for a distance equal or about equal to the length of the first leg 408 of the first bore 404, at which point a turn towards the terminal end 420 of the first bore 404 is initiated (step 1140). The second bore 428 is then continued along a second leg 440, until the dog leg portion 424 of the first bore 404 is intersected by the second bore 428 (step 1144). By intersecting the first bore 404 with the second bore 428, a continuous bore 124, extending between the first 128 and second 132 access points is formed. Moreover, in accordance with embodiments of the present invention, the continuous bore 124 is, at least between the down hole ends 148 and 152 of the tilted shafts 136 and 140, entirely within the resource deposit 112.

At step 1148, the drill string used to form the second bore 428 is further inserted and advanced along the first bore 404 towards the first access point 128. If the drill string used to form the first bore 404 has been left in that bore 404, it is removed ahead of the advancing drill string being inserted from the second access point 132. The advancement of the drill string from the second access point 132 is halted once that drill string emerges from the first access point 128. At step 1152, an end (e.g., the second end 616) of a rope sawing assembly 604 can be interconnected to the drill string at the first access point 128. The drill string is then withdrawn from the second access point 132, towing the sawing assembly 604 through the continuous bore 124 (step 1156). At step 1160, the drill string is removed from the second access hole 132, and the end of the sawing assembly 604 is passed up through the access hole 132.

At step 1164, the first and second ends 112 and 116 of the sawing assembly 604 are interconnected to a winch assembly 624. A sawing operation is then initiated (step 1168). In accordance with embodiments of the present invention, the sawing operation includes first pulling on a first end of the sawing assembly 604 while paying out a second end of the sawing assembly 604. After the sawing assembly 604 has traveled some distance, the operation is reversed, and the second end of the sawing assembly 604 is pulled while the first end of the sawing assembly 604 is paid out. In general, the distance traveled prior to reversal should be greater than the spacing or interval between cutting bits 620. However, to maintain level cutting forces, the majority of the cutting bits 620 should be engaged against the eroded edge 644 of the planar cavern 704, rather than against the sides of the first legs 408 and 428 of the first 404 and second 428 bores. In addition, for a given end of the sawing assembly 604, each pull will haul in more rope 608 than is subsequently paid out at that end, due to the shortening of the distance between the first 128 and second 132 access points traversed by the sawing assembly 604 as the eroded edge 644 of the planar cavern 704 advances towards the access points 128 and 132. In accordance with alternative embodiments, the sawing assembly can be pulled through the continuous bore hole 124 in one direction, in a continuous manner.

As the sawing operation continues, a solvent can be added to the continuous bore 124 (step 1172). For example, solvent can be added through one or both of the first 128 and second 132 access holes. By adding solvent while the sawing operation is being performed, shavings produced by the cutting action and the advancement of the eroded edge 644 of the planar cavern 704 can be removed. In addition, the presence of the solvent in the planar cavern 704 can be maintained at a level that is equal to or greater than the overburden pressure. In accordance with embodiments of the present invention, the addition of solvent to the continuous bore 124 can be facilitated by the provision of wash over casings placed in the first 136 and/or second 140 tilted shafts.

Figure 12:
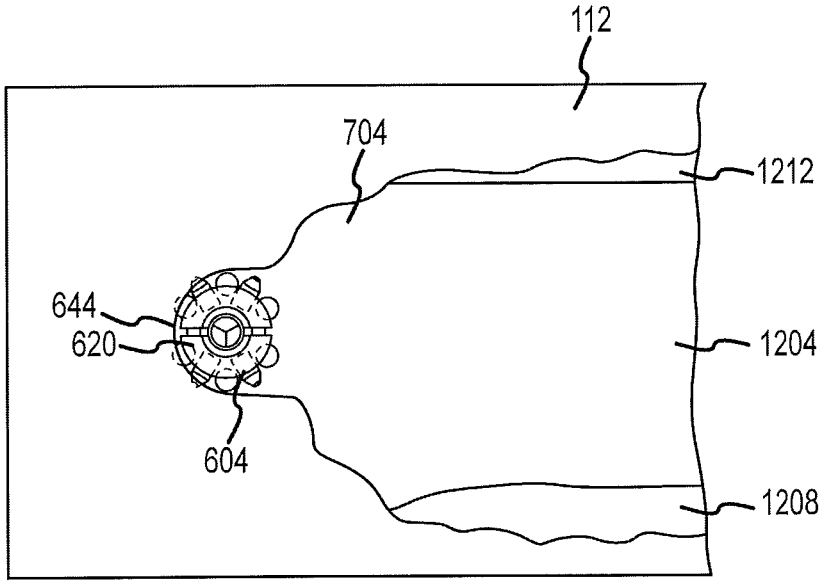
FIG. 12 is a cross-section of a planar cavern containing a solvent solution in accordance with embodiments of the present invention.

At step 1176, a determination can be made as to whether the pressure of the solvent in the planar cavern 704 is equal to or greater than the overburden pressure. If the pressure of the solvent in the planar cavern 704 is not equal to or greater than the overburden pressure, additional solvent can be added through an access hole 128 or 132 (step 1178). Maintaining solvent pressure at a level equal to or greater than the overburden pressure is desirable, in order to help prevent structural collapse of the planar cavern 704. In addition, dissolution of the floor and/or ceiling of the planar cavern 704 can be controlled. In particular, the floor of the cavern will cease to dissolve once the solvent becomes saturated with the target resource. In non-turbulent conditions, the saturated brine sinks to the bottom of the planar cavern 704, coating the floor and discouraging further dissolution. Ceiling dissolution can be ceased or inhibited by injecting a non-solvent liquid having a lower specific gravity than the solvent, such that the non-solvent liquid rests against the ceiling of the planar cavern 704. Where the solvent is water or a water based liquid, examples of non-solvent liquids that can be injected to control ceiling dissolution include diesel fuel and other light hydrocarbons. Accordingly, in non-turbulent conditions and prior to complete saturation of the solvent, the saturated brine with a density greater than pure water sinks to the bottom of the planar cavern 704, coating the floor and discouraging further dissolution, while the non-solvent liquid occupies a top layer of solution in the planar cavern 704, and unsaturated solution occupies a middle layer, between the non-solvent liquid and the saturated or pregnant solution. This is illustrated in FIG. 12, which shows a cross-section of the planar cavern 704, with unsaturated solvent 1204 generally held in a layer between saturated solvent 1208 lying along the partially dissolved floor 1008, and a light, non-solvent liquid 1212, forming a barrier against the partially dissolved ceiling 1004.

With reference again to FIG. 11, at step 1180, a determination may be made as to whether the eroded edge 644 of the planar cavern 704 has advanced to a maximum extent. In general, the eroded edge 644 will attain a curved shape. Moreover, it generally is not practical to continue sawing until the eroded edge 644 is straight or substantially straight. In particular, attempting to straighten the eroded edge 644, can result in kinking of the sawing assembly 604. Accordingly, once the sides of the planar cavern 704 have advanced down the parallel sides of the continuous bore 124 to the down hole ends 148 and 152 of the tilted shafts 136 and 140, the sawing operation should generally be discontinued to avoid damage to the sawing assembly 604 (step 1184). Once the eroded edge 644 has been advanced to a maximum point, the sawing assembly 604 can be removed through either the first 128 or the second 132 access hole.

At step 1188, a determination can be made as to whether the solution is sufficiently saturated. This determination can be made by allowing a selected period of time to elapse after introduction of the solvent to the planar cavern 704. As can be appreciated by one of skill in the art, the time required for a solvent to be saturated will depend on various factors, including temperature, pressure, agitation, material purity, and volume of solvent versus wetted surface area of the resource. Alternatively or in addition, the level of saturation of the solvent can be determined through sampling. Once a desired saturated level has been achieved, extraction of the pregnant brine can begin (step 1192). This can be performed by pumping the pregnant brine to the surface and placing it in solar reclamation or evaporation ponds (step 1196). The process may then end.

In accordance with an exemplary embodiment of the present invention, the area 144 within which the planar cavern 704 is formed can be rectangular. For example, and without limitation, the first legs 408 and 432 of the first 408 and second 428 bores can be parallel to one another, and can extend for about 1,000 feet. Moreover, the corners at the ends of the first legs 408 and 432 can describe a curve having a common radius. The second legs 416 and 440 of the first and second bores can have a length of about 1,000 feet. Accordingly, the area 144 in which the planar cavern 704 is formed can have a length of about 2,000 feet and a width of about 2,000 feet. As an example, the diameter of the continuous bore 124 formed by the horizontal directional drilling operation can be about 6 inches (about 15 centimeters). Where the ceiling 1004 and the floor 1008 of the planar cavern 704 comprise the target material 112, the exposed area is about 8 million square feet (about 744,200 square meters). Moreover, for an overburden 108 having a depth of about 480 feet (about 146 meters), if the tilted shafts 136 and 140 are at an angle of about 30°, the length of the continuous bore 124 that must be drilled is about 8,060 feet (about 2,457 meters).

As previously described, embodiments of the present invention can move the sawing assembly 604 in a reciprocating fashion. Where, for example, a distance between cutting bits 620 is 100 feet (about 30 meters), the amount of rope 608 that is withdrawn during a reciprocation cycle may be 120 feet (about 36 meters). In an exemplary embodiment, the cutting bits 620 may have a diameter of about 6 inches (about 15 centimeters) and a length of about 2 feet (about 61 centimeters). Where the sawing assembly 604 is moved in a continuous fashion, provision must be made to address contact between the cutting bits 620 and various components or structures that come into contact with the cutting bits 620 as a result of the continuous motion, such as wash over casings, sheaves, and winch drums. In accordance with still other embodiments, whether the sawing assembly 604 is moved in a reciprocating or a continuous fashion, cutting bits or members can comprise a coating applied to the rope. For example, a sawing assembly 604 can comprise a diamond rope saw.

Although exemplary embodiments of the present invention have been illustrated and described that include a continuous bore 124 that, at least within the resource deposit 112, describes three sides of a rectangle, other shapes are possible. For example, the continuous bore 124 can form a loop of any shape. In particular, the continuous bore 124 will include an angle or a curve in a portion of the continuous bore 124 that is within the resource deposit 112.

Figure 13:
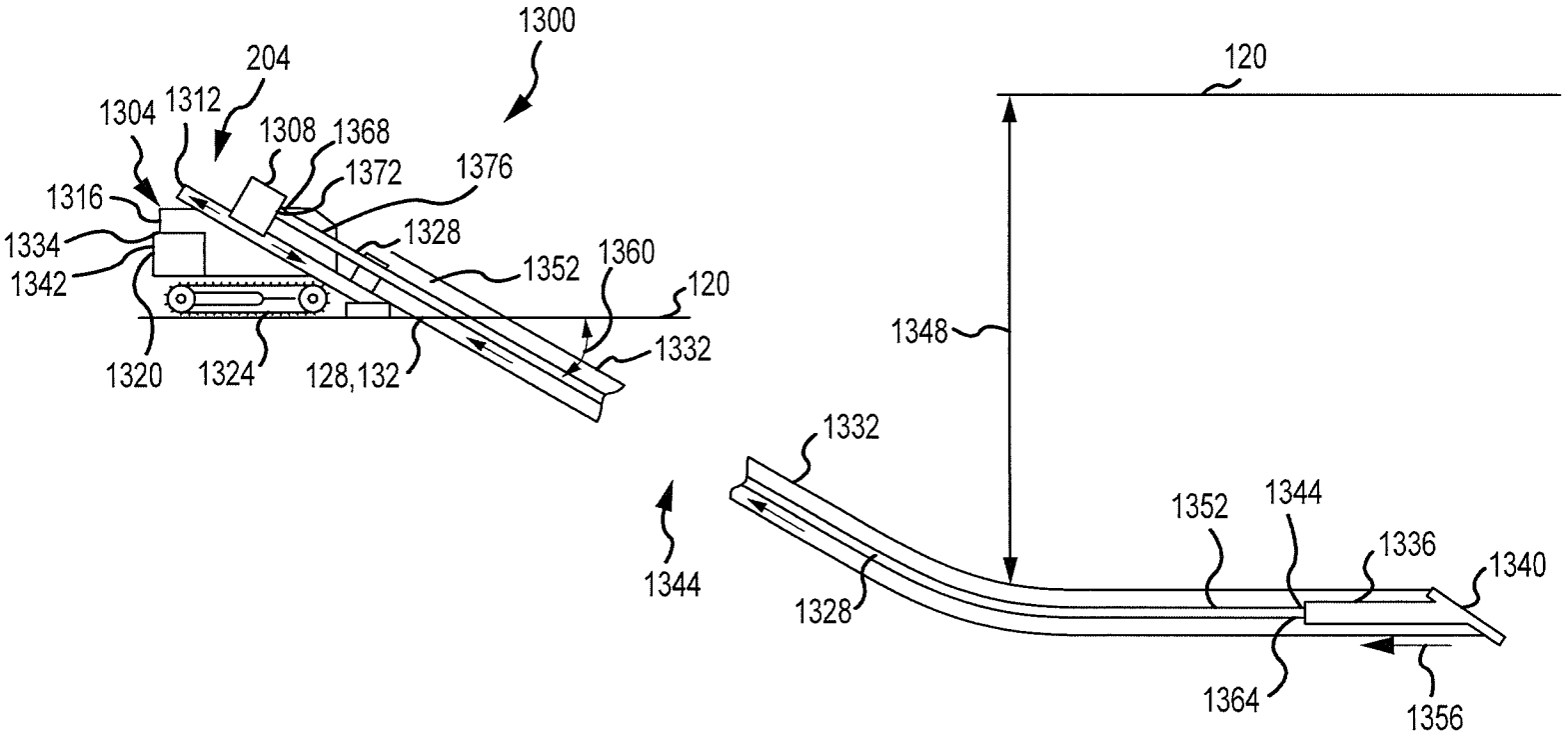
FIG. 13 is a vertical cross-section of a boring operation having above ground drilling equipment, a drill stem and tooling as well as the bore created by the equipment.

FIG. 13 illustrates a system 1300 used in connection with a boring process intended to recover a target soluble mineral from within or comprising a resource deposit 112 in accordance with embodiments of the present invention. The components of the process include a drilling rig 204 comprising a horizontal directional drill or a directional boring machine 1304 with spindle drive motor housing 1308, rack 1312 for spindle drive 1308 to traverse up and down, machinery bay 1316 containing an engine, fluid or mud pump and hydraulic system, a fluid reservoir 1320 and optional tracks 1324 to transport the boring machine 1304 to a bore site or access hole 128 or 132.

Further components include a sectional drill rod or stem 1328 that passes through the ground's surface 120 and follows the bore 1332 created by a drill head 1336. The drill head 1336 includes a steering face 1340 to facilitate redirecting the drill head 1336 and therefore the path of the bore 1332 as needed, in response to control input provided by an operator and/or an automated drill rig controller 1334 via a control or controls 1342. In accordance with at least some embodiments of the present invention, a downhole sensor 1344 can be included. The downhole sensor 1344 can sense a concentration and/or presence of the resource deposit at the location of the drill head 1336. As an example, the downhole sensor 1344 can comprise measurement while drilling equipment. As particular examples, the downhole sensor 1344 can include a beta and/or a gamma ray radiation sensor package, an electrical conductivity sensor, or other downhole sensor. Note that a break 1344 in the drill stem 1328 and earth 104 is provided to enhance clarity of the figure. The surface 120 beneath boring machine 1304 and the surface 120 above the drill head 1336 are one and the same with the vertical displacement between the illustrated sections of surface 120 being a function of the break 1344. Note that drill head 1336 is at a depth 1348 below the surface 120, and that this depth 1348 may be several hundred to several thousand feet. Also note that the illustrated bore 1332 may comprise all or a portion of a continuous bore 124 as described herein when the boring process is complete.

A fluid comprising a solvent and/or drilling fluid from the reservoir 1320 is pressurized at the boring machine 1304 and is pumped down the interior passage of the drill stem 1328, in the down hole direction indicated by double headed arrows 1352. After discharge adjacent to the steering face 1340, the fluid will mix with mineral cuttings and pass around the drill head 1336 back towards the access hole 128 or 132, in the direction of arrowhead 1356. In a first option, utilizing a single wall drill stem 1328, the fluid/cuttings mixture will return to the surface 120 between the annular space defined by the outer wall of the drill stem 1328 and the inner wall of the bore 1332. This first option is the classic method, however as the fluid passes through various differing strata that are encountered with a change in elevation due to the angle 1360 of the bore 1332, the fluid will pickup bits of said strata. A subsequent analysis of the fluid discharged from the bore 1332 proximate the boring machine 1304 at the surface 120 may not yield conclusive information on the properties of the material currently being engaged by drill head 1336.

To facilitate the availability of uncontaminated samples of the drilling fluid/cuttings produced proximate the drill head 1336, a second option can be employed. In particular, drill stem 1328 can be configured as a dual path or tube stem that permits conduction or passage of pressurized fluid from the boring machine 1304 to the drill head 213 in a first conduction path, permits passage of the spent fluid/cuttings back to the surface 120 in a second conduction path, without intermingling with various strata at elevations different than drill head 1336. To accommodate this, the second or return path must have an inlet 1364 adjacent the rear of the drill head 1336. The spent fluid will enter the drill stem 1328 here for its return trip to the surface and be discharged through a swivel 1368. Said swivel 1368 provides a non rotating connection to the rotating drill stem 1328 and allows drawing a sample of returned fluid and entrained and/or dissolved material through a sample port 1372 without interrupting the boring process. The returned fluid and entrained or dissolved material, which can include material from a resource deposit 112, can be sampled in a sample analyzer 1376, to determine a concentration of a resource. Alternatively or in addition, where a downhole sensor 1344 is provided, the sample analyzer 1376 can be provided with a signal from the downhole sensor related to the concentration of the target resource 112 at the location of the drill head. The concentration information can then be used in connection with providing control inputs as disclosed herein.

Figure 14:
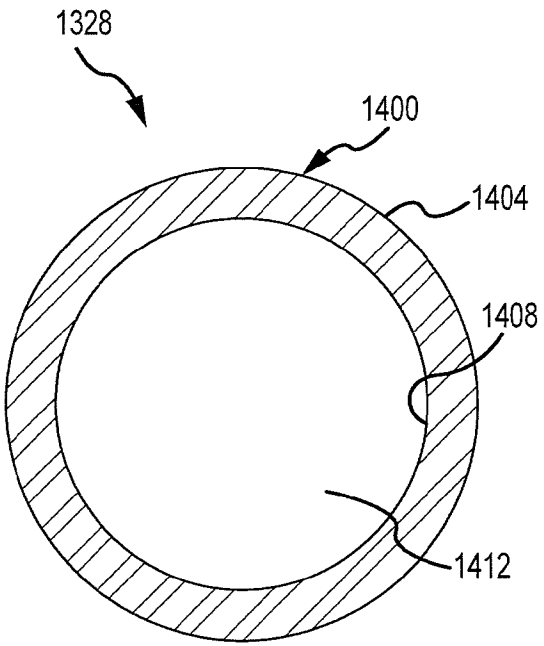
FIG. 14 is a lateral cross-section of the drill stem of FIG. 13.

FIG. 14 relates to the first option utilizing a single wall drill stem 1328 as described with respect to FIG. 13. FIG. 14 is a cross section of a drill stem 1328 comprising a single wall drill stem 1400. The outer wall 1404 and inner wall 1408 provide an interior passage 1412 for the conduction of fresh drilling fluid from the surface 120 to the drill head 1336. A return path for fluid and entrained and/or dissolved material is formed between the outer wall 1404 and the interior surface of the bore 1332. As an option, the passages may be reversed. For example, the reverse configuration might facilitate porting at the swivel 1368 spindle or at the drill head 1336.

Figure 15:
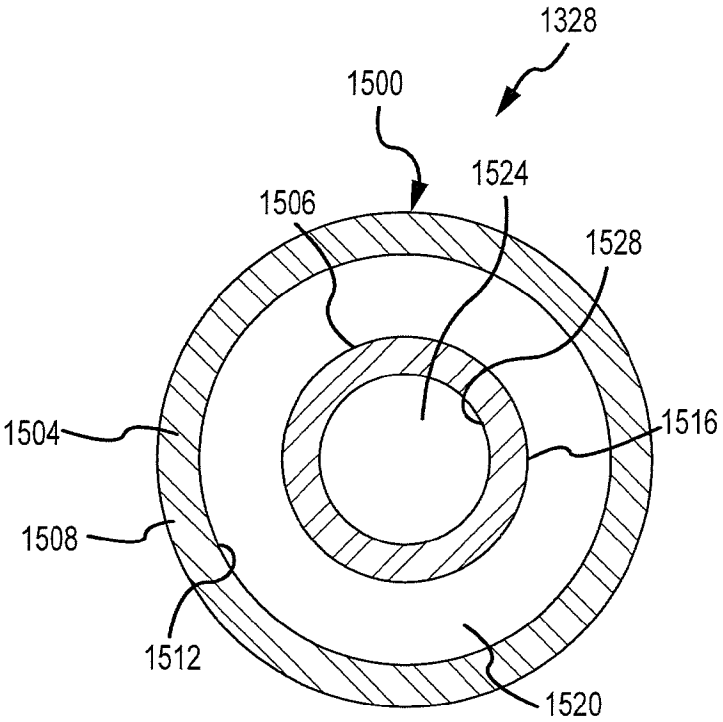
FIG. 15 is a lateral cross-section of an optional dual path drill stem that could be used in the operation of FIG. 13.

FIG. 15 relates to the second option utilizing a dual path or tube drill stem 1328 as described with respect to FIG. 13. FIG. 15 is a cross section of a drill stem 1328 comprising a dual path or tube drill stem 1500. The dual path drill stem 1500 includes an outer stem or tube 1504 and an inner stem or tube 1506. The outer wall 1508 of the outer stem 1504 is exposed to soil during boring. The inner wall 1512 of the outer tube 1504 and the outer wall 1515 of the inner stem 1506 define an annular space 1520 that is used to conduct spent drilling fluid from the drill head 1336 to the surface 120. A central passage 1524 of the inner tube by the inner wall 1528 of the inner tube conducts fresh drilling fluid from the surface 120 to the drill head 1336.

Figures 16, 17:
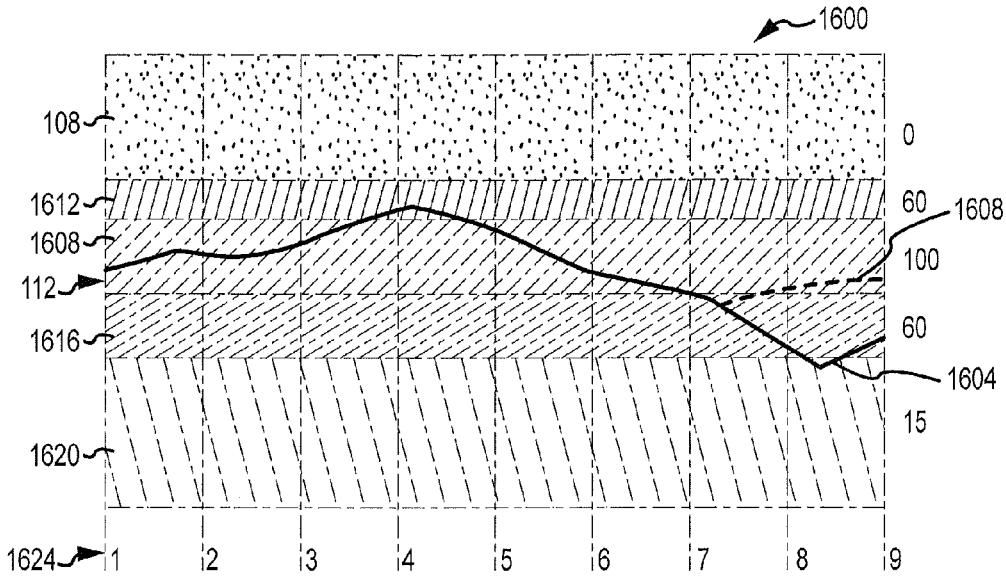
FIG. 16 is a vertical cross section of a bore path within various strata of target minerals.
FIG. 17 is a steering decision log sheet of the bore path of FIG. 16.

FIG. 16 shows an exemplary vertical cross section 1600 of a drill path 1604 (which may correspond to a bore 124 or 1332) within various mineral formations. The planar mineral deposits or target resource deposit 112 include the target salt 1608 comprising the highest concentration of the resource deposit 112, a low grade salt or ore 1612 above the target deposit 1608, overburden 108, a low grade salt 1616 below the target deposit 1608 and a lowest grade of salt 1620 at the lowest elevation shown. Accordingly, the salts in the target salt 1608, and low grade salt 1612 and 1616 strata can all comprise a portion of the resource deposit 112. However, it is generally desirable to form the drill path 1604, which typically forms one or more legs of a continuous bore 124, in the richest zone, the target salt 1612. Sample locations or points 1624 can be taken at horizontal intervals in the illustrated example, numbered as sample points 1 to 9. Progress of the bore 1604 starts at the intersection of the bore 1604 and sample point 1, then continues to the right. The drill path designated as 1604 has an alternate path 1608 that would be the result of pulling the drill string backwards from sample point 8 or beyond and redirecting the path per the dashed line of 1608.

FIG. 17 is an exemplary boring log having information relating to sample makeup returned through the dual tube drill stem 1500. The sample points relate to points described in FIG. 16, while the chemistry result at each point corresponds to the mineral deposit 112 values along the right side of FIG. 16.

At sample point 1, the chemistry result indicates that the drill head is in strata corresponding to the target salt or deposit 1608, the most valuable zone of the resource deposit 112, and there is no steering change required to stay in that deposit 1608. This set of logic continues as the boring progresses through sample points 2 and 3. At sample point 4 it is found that the sample quality has degraded to a value of 60 and it is realized that a steering correction must be implemented to return the bore path to the target deposit 1608. The chemistry has degraded from 100 to 60 indicating the drill has entered either strata 1612 or 1616. If no other information than sample chemistry is available at point 4, a decision must be made to steer up or down as a direction change must take place in an attempt to return to the target deposit 1608. Per the chart, the guess to steer down would be correct, confirmed with the sample at point 5, the chemistry has returned to 100, indicating that the drill head 1336 is in the target salt 1608. As it is desired to stay in this elevation, the drill head 1336 would be leveled off within the ability of the gravitational steering instrumentation and the bore continued to point 6, where per the chart, continued level (horizontal) steering would continue.

As the ability to steer in a perfectly horizontal direction is limited by the instrumentation and the tendency of a drill path to wander, this novel, secondary method of determining position relative to the target mineral in accordance with embodiments of the present invention is valuable. At point 7 the sample shows that the drill head 1336 has wandered out of the desired deposit 1608. Based on chemistry results of 60, the operator knows the drill head 1336 is either in strata 1612 or 1616. If the operator's estimate is incorrect at this point and additional downward steer is added, the mistake will become apparent by point 8 where the chemistry has dropped further to 15. By comparing the strata chemistry values to the original exploratory vertical borings that located the deposit 112 initially, the operator has relatively good confirmation at point 8 that the drill head 1336 is below the target strata given the dwindling chemistries of the previous samples.

At this juncture the boring process is flexible enough to allow two methods of correction. Up angle may be added as shown in the bore path 1604 between points 8 and 9 at the far right end of the cross section, or the operator may pull back the drill stem to point 7 and redirect the bore path per dashed line 1608.

Figure 18:
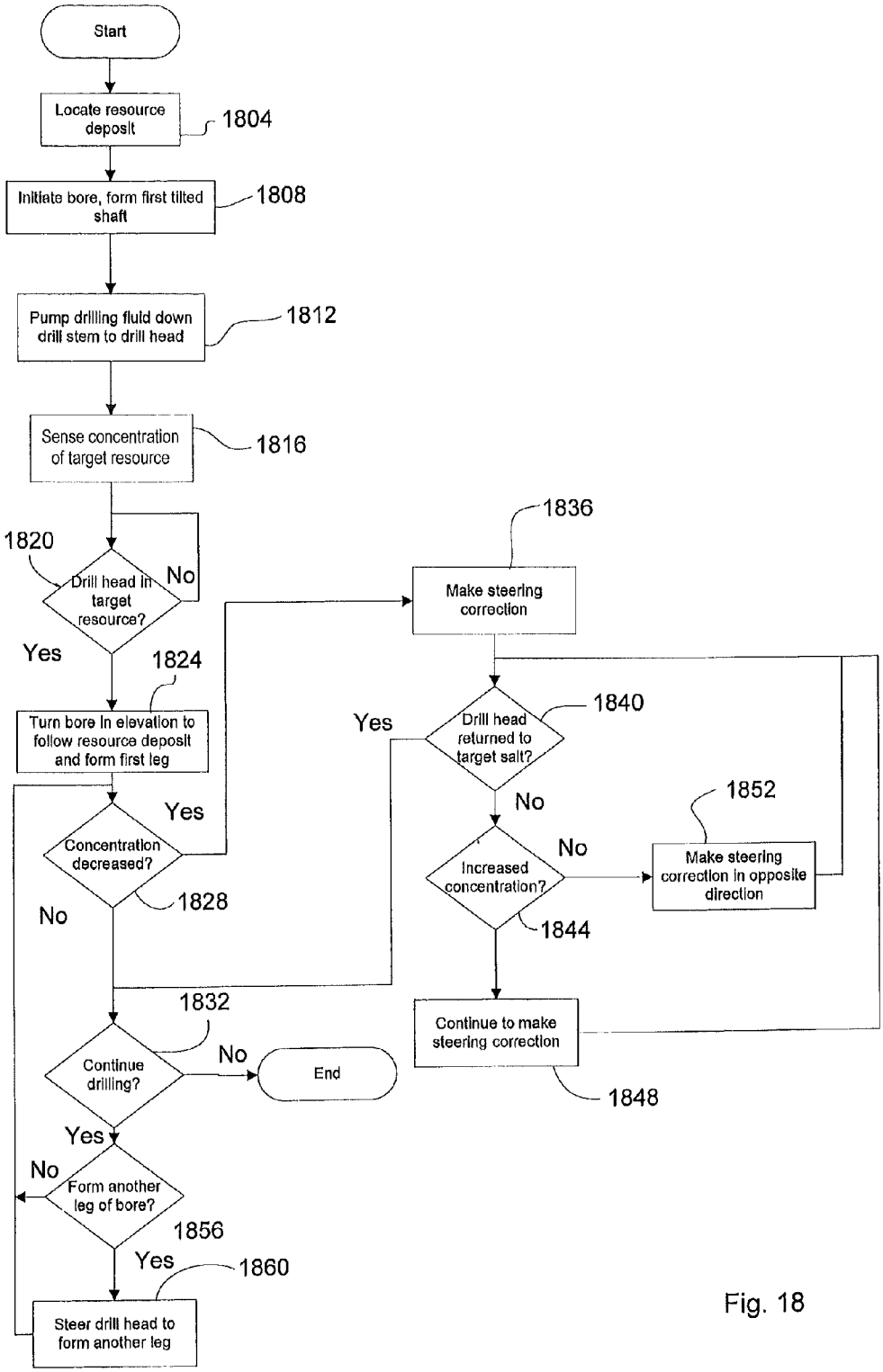
FIG. 18 is a flowchart illustrating aspects of a method for forming a planar cavern in accordance with embodiments of the present invention.

FIG. 18 is a flowchart depicting aspects of a method for forming a planar cavern, and in particular for steering a drill head 1336 in accordance with embodiments of the present invention. Initially, at step 1804, the resource deposit 112 is located, and a location for forming an access hole 128 is selected. A bore 1332 is then initiated, to form a first tilted shaft 136 (step 1808). At step 1812, drilling fluid is pumped down the drill stem 1328 to the drill head 1336 (step 1812). As can be appreciated by one of skill in the art after consideration of the present disclosure, drilling fluid can be pumped down the drill stem 1328 to the drill head 1336 during the entire drilling process. Alternatively, drilling fluid can be pumped down the drill stem 1328 to the drill head 1336 when the drill head 1336 is believed to have entered or to be proximate to the target resource 112 or resource deposit. As yet another alternative, different drilling fluids can be used at different points in the formation of the bore 1332. For example, a drilling fluid suited to drilling through a particular overburden can be used during the initial formation of the bore, while a drilling fluid comprising a solvent can be used when the drill head 1336 is within or near the resource deposit 112. At step 1816, a concentration of the target resource 112 at the location of the drill head 1336 is determined. For instance, a sample of the return flow of drilling fluid and entrained or dissolved materials is taken. For example, where the drill stem 1328 used to create the bore 1332 is a single wall drill stem, the drilling fluid can be pumped down the interior passage of the drill stem, and the cuttings and any dissolved materials are returned within the annular space between the outer wall of the drill stem 1328 and the inner wall of the bore 1332. In accordance with still other embodiments, where a dual path or dual wall drill stem 1328 is utilized, the drilling fluid can be pumped down the central passage 1524 of the drill stem 1328, while spent drilling fluid, cuttings, and dissolved material can be returned using the conduit comprising the annular space 1520 defined by the outer wall 1516 of the inner stem 1506 and the inner surface or wall 1508 of the outer tube 1504 of the dual path drill stem 1328. As another example, a downhole sensor 1344 provides a signal identifying the concentration of the target resource 112 at the location of the drill head 1336.

In accordance with embodiments of the present invention, the return flow is sampled in order to determine a concentration of a resource deposit 112 at the location of the drill head 1336. Moreover, as described herein, the detected or sampled concentration of the resource deposit 112 can be used to steer the drill head 1336, in order to form a bore 1328 that remains within the strata comprising the richest concentration of the resource deposit 112 (e.g. target salt 1608). At step 1820, a determination is made as to whether the drill head 1336 is within the strata of the target resource 112 comprising the target salt 1608. In general, the drill head 1336 is determined to be within the strata comprising the target salt 1608 if the concentration of the resource deposit 112 within the sampled return flow of drilling fluid is at or above a selected threshold value. If it is determined that the drill head has not reached the resource deposit 112, the bore 1328 can continue to be formed, and samples of the return flow of drilling fluid can continue to be taken. Once it is determined that the drill head 1336 has reached the resource deposit 112, and in particular a strata corresponding to the desired or target resource deposit 1608, the bore 1328 can be turned in elevation to follow that strata, and to form the first leg of a continuous bore 124 (step 1824). As can be appreciated by one of skill in the art, the turn in elevation need not be to continue the bore 1328 in a direction that is absolutely horizontal. Instead, the bore 1328 will be continued in a direction that follows the tilt of the strata comprising the resource deposit 112 at that location in the Earth. Accordingly, the turn in elevation can be to an angle that is parallel to the predominant tilt of the strata in the geographic region, along the direction of the bore 1328 being formed.

In accordance with embodiments of the present invention, the concentration of a target resource in the return flow of drilling fluid is monitored constantly or at intervals while drilling progresses. Accordingly, at step 1828, a determination may be made as to whether the concentration of the target resource in the return flow has decreased. If a decrease in the concentration of the target resource is detected, a steering correction can be made (step 1836). The direction in which a steering correction is made can vary, depending on the particular implementation of the present invention, and/or the circumstances in which the method is employed. For example, an initial correction in the angle at which the drill head 1336 drills the bore can be in a downward (or alternately upward) direction. As yet another example, the change in direction or elevation angle can be in view of materials other than the target resource detected in the return flow of drilling fluid. For example, if a specific material was detected in an overburden 108, the reappearance of that material in the return flow can indicate that the drill head 1336 should be steered downwardly. Similarly, the drill head 1336 can be steered upwardly in response to the appearance of a specific material in a return flow that is known to underlie the resource material 112.

After making a steering correction, a determination may be made as to whether the drill head has returned to the resource deposit 112 (step 1840). For example, if the concentration of the target resource in the return flow to the sample analyzer 1376 or as sensed by a downhole sensor 1344 has returned to at least some threshold level, the drill head 1336 may be considered to have returned to the target resource, and drilling of the bore 1328 can continue (step 1832). If the drill head has not returned to the strata comprising the target salt, the concentration of the target resource in the return flow will not have returned to the threshold value. In this case, a determination can be made as to whether the concentration of the target resource in the return flow has increased or not following the steering correction (step 1844). If the concentration has increased, the steering correction can be continued (step 1848). For example, if the correction resulted in the drill head 1336 being steered at a first angle with respect to horizontal, the drill head 1336 may continue in that first direction. Alternatively, if the concentration of the target resource 112 in the return flow has decreased, a steering correction in the opposite direction can be made (step 1852). As can be appreciated by one of skill in the art after consideration of the present disclosure, a correction in an opposite direction does not require that the change in steering angle be confined to a change within a single plane. For example, where the drill head 1336 has been steered to follow a path with a non-zero vertical component, a steering correction can include some change to the angle with respect to horizontal, with or without a change in the horizontal direction of the bore 1332. After continuing the original steering correction at step 1848, or after initiating a second steering correction that is in a direction opposite the first steering correction, the process may return to step 1840 to determine whether the drill head 1336 has returned to the strata comprising the target salt 1608. In accordance with further embodiments of the present invention, a steering correction can include initiating a cyclic or porpoising pattern to facilitate relocating the strata comprising the target salt 1608. Moreover, the pattern can be of increasing amplitude. In addition, although examples of the monitoring of resource concentrations has been discussed in connection with changes to steering of the drill head 1336 in the vertical direction, embodiments of the present invention can also be applied in connection with steering the drill head 1336 in the horizontal direction, or in both vertical and horizontal directions.

After determining that the concentration of the target resource 112 has not decreased, and therefore that the drill head 1336 is following the strata having the highest concentration of the target resource 112 deposit at step 1828, or after determining that the drill head 1336 has returned to the strata comprising the target salt 1608 at step 1840, the drilling process continues. At step 1832, a determination may be made as to whether drilling of the bore 1328 should be continued. If drilling is to be continued, a determination may be made as to whether another leg of the bore 1328 is to be formed. If another leg of the bore is to be formed, the drill head can be steered within a horizontal plane to form the additional leg (step 1860). The process can then return to step 1828, and the concentration of the target resource 112 in the return flow of drilling fluid can continue to be monitored, to ensure that the drill head 1336 remains in the resource deposit. Similarly, if another leg of the bore is not required at the point the decision is taken, the process can return to step 1828. After a continuous bore has been completed using steering techniques that monitor the concentration of the target resource in the return flow of drilling fluid as described herein, formation of a planar cavern can be completed as also described herein.

As can be appreciated by one of skill in the art after consideration of the present disclosure, changes in the direction of the bore 1332 determined as described herein can be entered as steering inputs through the drilling rig 204 controls 1334. Moreover, these inputs can be entered by a human operator or an automated controller in response to target resource or material 112 concentration information determined by an analyzer 1376 or manually obtained sample concentrations.

While the conventional electronics provided as part of the drilling rig that are used to guide the bore path are useful to forming a continuous bore 124 without a resource deposit 112, verification that the bore path lies largely within the target mineral deposit by sampling returns and making corrections in response to the sample readings as disclosed herein is provided by embodiments of the present invention. Embodiments of the present invention can also be used to place components or legs of a continuous bore 124 within a resource deposit where survey or previously collected information concerning the location of the resource deposit 112 is incomplete or non-existent.

Figure 19:
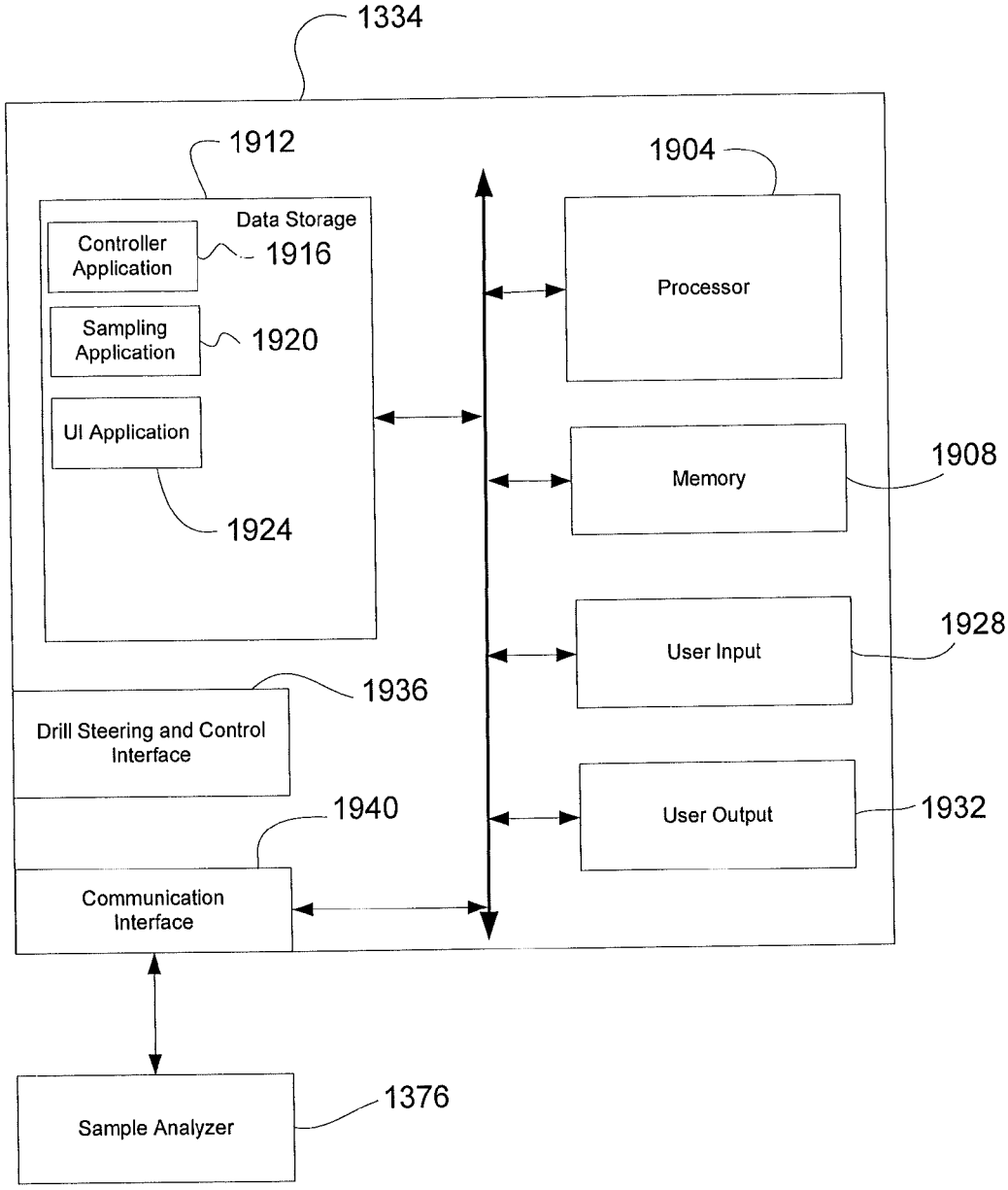
FIG. 19 is a block diagram of a controller of a directional drilling rig in accordance with embodiments of the present invention.

FIG. 19 is a block diagram depicting components of a drill rig controller 1334 associated with or included in a horizontal directional drill or a directional boring machine 1304 in accordance with embodiments of the present invention. In general, the drill rig controller 1334 includes a processor 1904. The processor 1904 may comprise a general purpose programmable processor or controller for executing application programming or instructions. In accordance with at least some embodiments, the processor 1904 can include multiple processor cores, and/or implement multiple virtual processors. In accordance with still other embodiments, the processor 1904 may include multiple physical processors or controllers. As a particular example, the processor 1904 may comprise a specially configured application specific integrated circuit (ASIC) or other integrated circuit, a digital signal processor, a controller, a hard wired electronic or logic circuit, a programmable logic device or gate array, a special purpose or programmed computer, or the like. The processor 1904 generally functions to run programming code or instructions implementing various functions of the drill rig controller 1334.

A drill rig controller 1334 can also include memory 1908 for use in connection with the execution of application programming or instructions by the processor 1904, and for the temporary or long term storage of program instructions and/or data. As examples, the memory 1908 may comprise RAM, DRAM, SDRAM, or other solid state memory. Alternatively or in addition, data storage 1912 may be provided. Like the memory 1908, the data storage 1912 may comprise a solid state memory device or devices. Alternatively or in addition, the data storage 1912 may comprise a hard disk drive or other random access memory. Where the processor 1904 comprises a controller, memory 1908 and/or data storage 1912 can be integral to the processor 1904.

Examples of application programming that can be stored on or in association with a drill rig controller 1334 in accordance with embodiments of the present invention, for example in data storage 1912, include a controller application 1916, a sampling application 1920, and a user interface application 1924. A controller application 1916 can operate to implement methods for controlling a horizontal directional drill 1304 as disclosed herein. The sampling application 1920 can comprise programming code for controlling the operation of a sample analyzer 1376 and/or for processing input provided by a sample analyzer 1376 and/or a downhole sensor 1344. A user interface application 1924 can process and/or format data that is output to a user or operator of the horizontal directional drill 1304, and can accept control input from the user. In accordance with at least some embodiments, the user interface application 1924 can comprise a graphical user interface.

The drill rig controller 1334 can additionally include a user input 1928 and a user output 1932. As examples, a user input 1928 can include a keyboard, keypad, control lever, control button, switch, touch screen or microphone. Examples of a user output 1932 include a display screen or monitor, indicator lamps and a speaker. In general, user inputs 1928 can allow a user to control aspects of the operation of the horizontal directional drill 1304, while the user output 1932 provides status information to the user.

A drill steering and control interface 1936 can be included. The drill steering and control interface can operatively interconnect the drill rig controller 1334 to operational controls associated with the horizontal drilling rig 1304, for example to provide control instructions regarding advancing a drill head, steering the drill head, pumping a drilling fluid or solvent into a drill stem 1328 and/or bore 1332, and for otherwise controlling the operation of the horizontal directional drill 1304. In accordance with at least some embodiments, the drill steering and control interface 1936 can include a port for physically interconnecting the drill rig controller 1334 to an electronic interface associated with controls 1342. In accordance with still other embodiments, the drill steering and control interface 1936 can include a control module that operates to receive signals from the controller application 1916, and to transform those signals into control signals that can be acted on by the controls 1342.

A communication interface 1940 can be included to interconnect the drill rig controller 1334 to peripheral devices, a communication network, other computer devices, and the like. As a particular example, the communication interface 1940 can interconnect the drill rig controller 1334 to a sample analyzer 1376. Control signals exchanged between the sampling application 1920 and the sample analyzer 1376 can include instructions to the sample analyzer 1376 to take a sample of the concentration of a target resource in a drilling fluid. Examples of signals provided by the sample analyzer 1376 to the drill rig controller 1334 include data indicating the concentration of a target resource in a drilling fluid. Moreover, information returned from the sample analyzer 1376 may comprise raw data returned by the sample analyzer 1376 as translated by the sampling application 1920. In accordance with alternate embodiments, the sample analyzer 1376 can return concentration information to the drill rig controller 1334 that is provided directly to the controller application 1916, for example where the sample analyzer 1376 is a stand alone device and the drill controller 1334 does not include a sampling application 1920. Information regarding resource concentration in a sample taken from a return flow of fluid can be correlated with information regarding the location of the drill head 1336 when the sample was taken and applied by the controller application 1916 to provide control inputs to the horizontal directional drill 1304 in connection with implementing methods as described herein.

Although examples provided herein have discussed the use of water or water-based solutions as solvents, and has given as examples sylvite and halite as target resources, other solvents and target resources can be used to recover resources using a planar cavern formed using methods and/or systems in accordance with embodiments of the present invention. In particular, any subsurface deposit that can be dissolved in a liquid can be recovered using embodiments of the present invention. Moreover, embodiments of the present invention can be usefully employed wherever a subsurface cavern having a large surface area is desired.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A method for forming a planar cavern, comprising:

drilling a first bore using a first drill string that includes a first drill head, wherein the first bore extends from a first access point through an overburden;

extending the first bore through the overburden to a first resource deposit;

first sensing a concentration of the first resource at or about a location of the first drill head, wherein the first sensing a concentration of the first resource at or about a location of the first drill head includes:

introducing a solvent to the first bore, wherein the solvent is a solvent with respect to at least a first material in the first resource deposit;

receiving a return flow of the solvent;

determining a concentration of the first material in the return flow by analyzing at least a first sample in the return flow of the solvent;

steering the first drill head in response to determining a concentration of the first material in the return flow, wherein a direction of the first bore is altered.

2. The method of claim 1, wherein the first sensing a concentration of the first resource at or about a location of the drill head includes sensing a radiation level at the location of the drill head.

3. The method of claim 1, wherein steering a drill head in response to first sensing a concentration of the first material at or about a location of the first drill head includes:

steering the drill head in a first non-horizontal direction, wherein the first bore is extended for some distance in the first non-horizontal direction;

after extending the first bore for some distance in the first non-horizontal direction, second sensing a concentration of the first material at or about a location of the first drill head;

in response to determining that a first parameter measured with respect to the first sensing a concentration is less desirable than the first parameter measured with respect to the second sensing a concentration, continuing the first bore in the first non-horizontal direction;

in response to determining that the first parameter measured with respect to the first sensing a concentration is more desirable than the first parameter measured with respect to the second sensing a concentration, steering the drill head in a second non-horizontal direction.

4. The method of claim 3, wherein the second direction includes a directional component that is opposite a directional component of the first non-horizontal direction.

5. The method of claim 3, wherein the first parameter is a concentration of the first material.

6. The method of claim 5, wherein the first material in the resource deposit is potash.

7. The method of claim 1, further comprising:

forming a continuous bore, wherein the continuous bore extends from the first access point to a second access point;

placing a sawing assembly in the continuous bore;

moving the sawing assembly relative to the continuous bore, wherein moving the sawing assembly relative to the continuous bore forms a planar cavern.

8. The method of claim 7, further comprising:

introducing the solvent to the planar cavern.

9. The method of claim 8, further comprising:

agitating the solvent in the planar cavern.

10. The method of claim 9, wherein agitating the solvent in the planar cavern includes moving the sawing assembly within the planar cavern.

11. The method of claim 8, further comprising:

removing a brine from the planar cavern, wherein the brine includes a concentration of the first material dissolved in the solvent.

12. The method of claim 8, wherein the drill string includes a multiple path drill rod, wherein the solvent is introduced to the first bore through a first path included in the multiple path drill rod, and wherein the return flow of the solvent and first material in solution is carried by a second path included in the multiple path drill rod.

13. An apparatus for forming a planar cavern, comprising:

a horizontal directional drill, including:

a drill head;

a hollow drill rod, wherein the hollow drill rod provides at least a first fluid conduit for at least a first solvent;

a resource concentration sensor;

a control, wherein operation of the horizontal directional drill is controlled to form a bore that follows a resource deposit over at least a first portion of the bore, wherein the control receives information from the resource concentration sensor regarding a concentration of a resource at a location of the drill head, wherein the control alters a direction of the bore in response to the information received from the resource concentration sensor, and wherein the at least a first solvent is introduced to the at least a first portion of the bore and is agitated.

14. The apparatus of claim 13, wherein in a first mode of operation at least a portion of the first solvent is contained within the first fluid conduit, wherein the resource concentration sensor senses a concentration of the first resource in the first solvent.

15. The apparatus of claim 14, wherein the hollow drill rod is a multiple wall drill rod that includes at least the first fluid conduit and a second fluid conduit, wherein in a first mode of operation the first fluid conduit is operable to provide the first solvent to a bore face adjacent the drill head and the second fluid conduit is operable to return at least some of the first solvent and the resource to a sample port proximate to a first access hole;

an inlet adjacent the drill head, wherein the inlet is in communication with the second fluid conduit and is operable to admit the at least some of the first solvent and the resource to the second fluid conduit for transport to the sample port.

* * * * *